US010266339B2

(12) United States Patent
Preen et al.

(10) Patent No.: US 10,266,339 B2
(45) Date of Patent: Apr. 23, 2019

(54) HOUSEHOLD WASTE RECYCLING MODULE AND APPLIANCE ASSEMBLY

(75) Inventors: Martin Preen, Bourne (GB); Iain Dulley, Bourne (GB)

(73) Assignee: Krushr Limited, Bourne (GB)

( * ) Notice: Subject to any disclaimer, the term of this patent is extended or adjusted under 35 U.S.C. 154(b) by 835 days.

(21) Appl. No.: 13/884,588

(22) PCT Filed: Nov. 7, 2011

(86) PCT No.: PCT/GB2011/052159

§ 371 (c)(1),
(2), (4) Date: May 9, 2013

(87) PCT Pub. No.: WO2012/063051

PCT Pub. Date: May 18, 2012

(65) Prior Publication Data

US 2013/0220150 A1 Aug. 29, 2013

(30) Foreign Application Priority Data

Nov. 9, 2010 (GB) ..... 1018921.5

(51) Int. Cl.
*B30B 9/30* (2006.01)
*B65F 1/14* (2006.01)
(Continued)

(52) U.S. Cl.
CPC ..... *B65F 1/1405* (2013.01); *A47B 77/18* (2013.01); *B30B 1/006* (2013.01); *B30B 9/306* (2013.01); *B30B 9/3032* (2013.01); *B65F 1/1436* (2013.01)

(58) Field of Classification Search
CPC ..... B30B 1/006; B30B 9/321; B30B 9/3003; B30B 9/3032; B30B 9/306; B02C 10/0081; B65F 1/1405; B65F 1/1436; A47B 77/18
(Continued)

(56) References Cited

U.S. PATENT DOCUMENTS 2,124,511 A * 7/1938 Schmitz ..... B42F 17/02 220/542
3,460,463 A * 8/1969 Jernstrom ..... B30B 1/18 100/126
(Continued)

FOREIGN PATENT DOCUMENTS

DE 2 008 519 2/1972
DE 2008519 2/1972
(Continued)

OTHER PUBLICATIONS

Machine-generated English-language translation of De 2008519 obtained from Espacenet.com on May 8, 2013.
(Continued)

*Primary Examiner* — Jimmy T Nguyen
(74) *Attorney, Agent, or Firm* — DASCENZO Intellectual Property Law, P.C.

(57) ABSTRACT

The present invention includes a packaging, carton and container compacting and storing module including a receptacle. The module also includes a drive assembly and a compacting assembly. The drive assembly is operably connected to the compacting assembly, and, during a compacting operation, the drive assembly drives the compacting assembly into the receptacle.

17 Claims, 13 Drawing Sheets

(51) Int. Cl.
*A47B 77/18* (2006.01)
*B30B 1/00* (2006.01)

(58) Field of Classification Search
USPC ..... 100/218, 240, 245, 246, 281, 283, 902, 100/229 A; 220/908, 909
See application file for complete search history.

(56) References Cited

U.S. PATENT DOCUMENTS

| | | | | |
|---|---|---|---|---|
| 3,714,890 | A | 2/1973 | Moon | |
| 3,722,971 | A | 3/1973 | Zeischegg | |
| 3,734,006 | A * | 5/1973 | Hennells | B30B 9/3057 100/193 |
| 3,753,400 | A | 8/1973 | Miller | |
| 3,765,148 | A | 10/1973 | Ippolito et al. | |
| 3,768,398 | A * | 10/1973 | Ullman, Jr. | B30B 9/3017 100/218 |
| 3,831,514 | A * | 8/1974 | Jernstrom | B30B 9/3042 100/229 A |
| 3,834,776 | A | 9/1974 | Becker, Jr. | |
| 3,851,578 | A | 12/1974 | Engebretsen | |
| 3,995,543 | A | 12/1976 | Montalbano | |
| 4,054,088 | A | 10/1977 | Nee | |
| 4,064,798 | A * | 12/1977 | Wolbrink | B30B 9/306 100/218 |
| 4,100,850 | A * | 7/1978 | Wolbrink | B30B 1/006 100/229 A |
| 4,119,028 | A * | 10/1978 | Khan | B30B 9/3032 100/218 |
| 4,188,879 | A * | 2/1980 | Judd | B30B 9/3003 100/229 A |
| 4,213,386 | A | 7/1980 | Telling | |
| 4,269,114 | A * | 5/1981 | Schwarz | B30B 1/003 100/229 A |
| 4,407,191 | A * | 10/1983 | Brenner | B30B 9/3007 100/229 A |
| 4,518,142 | A | 5/1985 | Sulcek et al. | |
| 4,548,132 | A * | 10/1985 | Moon | B30B 1/006 100/229 A |
| 4,638,730 | A | 1/1987 | Bonacorsi | |
| 5,001,977 | A * | 3/1991 | Tracy | B30B 1/006 100/102 |
| 5,002,346 | A | 3/1991 | Gasser | |
| 5,364,181 | A | 11/1994 | Scheible | |
| 5,417,154 | A | 5/1995 | Plaats | |
| 6,367,377 | B1 * | 4/2002 | Gawley | B30B 1/006 100/229 A |
| 6,923,114 | B2 | 8/2005 | Koch | |
| 7,536,948 | B1 | 5/2009 | Cockrum | |
| 2005/0061167 | A1 | 3/2005 | Fox | |
| 2008/0041246 | A1 | 2/2008 | Fox | |
| 2009/0314169 | A1 | 12/2009 | Kachkovsky | |
| 2011/0056393 | A1 * | 3/2011 | Kachkovsky | B30B 1/103 100/45 |
| 2011/0192293 | A1 * | 8/2011 | Hitchcock | B30B 1/10 100/229 A |

FOREIGN PATENT DOCUMENTS

| | | | |
|---|---|---|---|
| DE | 89 00 054 | | 5/1989 |
| DE | 8900054 | | 5/1989 |
| DE | 4313764 | | 11/1993 |
| DE | 296 20 192 | | 1/1997 |
| DE | 29620192 | | 1/1997 |
| EP | 0096898 | A1 | 12/1983 |
| EP | 1707345 | | 10/2006 |
| EP | 1 745 921 | | 1/2007 |
| EP | 1745921 | | 1/2007 |
| FR | 2062731 | | 6/1971 |
| FR | 2159109 | | 6/1973 |
| FR | 2246469 | A1 | 5/1975 |
| GB | 1 218 152 | | 1/1971 |
| GB | 1218152 | | 1/1971 |
| GB | 1257272 | | 12/1971 |
| GB | 1342466 | | 1/1974 |
| GB | 2447612 | | 9/2008 |
| GB | 2455232 | A | 6/2009 |
| JP | 2001259894 | | 9/2001 |
| WO | WO 02102580 | | 12/2002 |
| WO | WO 2008000510 | A2 | 1/2008 |
| WO | WO 2009073039 | | 6/2009 |
| WO | WO 2010034494 | | 4/2010 |

OTHER PUBLICATIONS

English-language abstract of DE 4313764 obtained from Espacenet.com on May 9, 2013.
English-language abstract of EP 0096898 A1 obtained from Espacenet.com on May 8, 2013.
Machine-generated English-language translation of FR 2246469 A1 obtained from Espacenet.com on May 8, 2013.
English-language abstract of JP 2001259894 obtained from European Patent Office.
English-language abstract of WO 02102580.
English translation of German Utility Model No. DE 89 00 054.
English translation of German Utility Model No. DE 296 20 192.
Machine-generated English translation of DE 2 008 519, downloaded from Espacenet.com, Mar. 3, 2016.

* cited by examiner

HOUSEHOLD WASTE RECYCLING MODULE AND APPLIANCE ASSEMBLY

BACKGROUND OF THE INVENTION

This invention relates to household waste compacting and storing. In particular, although not exclusively, the invention relates to a household appliance for compacting and storing packaging, cartons and containers.

Pressure to recycle has led to many household waste collection services offering the facility to treat recyclable and non-recyclable waste differently. This generally requires households to separate recyclable waste from non-recyclable waste and even to sub-divide recyclable waste into different types. As a result, households need to be able to store all the different types of waste ready for collection. What is more, in order to store waste efficiently, it is preferable to compacting or compact it first. Take, for example, packaging, cartons and containers, e.g. plastics drink or food containers, such as cans; once emptied, they have a large volume to weight ratio, and it is much more efficient to store them in a compacted, reduced volume form. So, there is a requirement for a household appliance that can not only store recyclable waste but also compact it first.

BRIEF SUMMARY OF THE INVENTION

In a first aspect, the invention provides a packaging, carton and container compacting and storing module comprising a receptacle, and drive means and a compacting means, wherein the drive means is operably connected to the compacting means, and, during a compacting operation, the drive means drives the compacting means into the receptacle.

Any cartons, packaging or containers in the receptacle are compacted by the action of the compacting means. Following a compacting operation, the drive means drives the compacting means in a withdrawing operation out of the receptacle.

The module may suitably comprise a chassis, enclosed on all sides apart from its front by a skin, e.g. of a plastics material. Aptly, the receptacle is mounted, e.g. slidably mounted, in the chassis. In one embodiment, the receptacle is slidable in and out of the front of the chassis to and from the rear of the chassis in a generally horizontal direction of sliding.

Often the receptacle is elongate from the front to the rear, and is slidable in and out of the front of the chassis to and from the rear of the chassis in a direction generally corresponding to its elongate dimension.

Often the receptacle is in the form of an open-top generally cuboidal box-shaped structure, splaying slightly on all sides in the direction of the top side of the chassis, and is smaller than the container part.

Often the receptacle has a pull-out insert which conforms at least in part to the receptacle, sits in the receptacle and is slidable upwardly out of the receptacle. Where the receptacle is in the form of an open-top generally cuboidal box-shaped structure, the pull-out insert conforms at least to the bottom and each side of the receptacle. It conveniently has lifting means, such as handles, for example at each side. Following a compacting operation, the pull-out insert aids in the removal of recyclable waste compacted by the action of the compacting means from the receptacle.

Aptly, the drive means is fixedly or pivotally mounted within the module.

Aptly, the module also comprises a drawer which slidably mounted in the module and may thus be slid relative to a fixed or pivoted drive means. Aptly, the drive means is fixedly or pivotally mounted above the drawer, and during a compacting operation, the drive means drives the compacting means downwardly into the receptacle. In such an embodiment, the compacting means should in its rest position before the compacting operation be clear of the receptacle.

Aptly the compacting means is in the form of a compacting plate, e.g. a planar and rectangular plate which extends in a generally horizontal direction, and during a compacting operation, the drive means drives the compacting plate downwardly into the receptacle from its rest position clear of the receptacle before the compacting operation. Often the receptacle is elongate from the front to the rear. Aptly, the compacting means conforms to the inside of the receptacle close to the bottom of the receptacle in use. Aptly, the compacting means is a planar, rectangular plate which is elongate in the direction in which the receptacle is elongate.

The drawer may have a front mounted on a container part, and the receptacle is received by, and sits in the drawer container part.

The front is suitably planar, and aptly rectangular. The receptacle aptly conforms to the container part, so that the latter holds the receptacle. The container part may be an open framework, e.g. it may be an enclosure with a cage-like structure formed by intersecting members.

In one embodiment, the cage-like container part comprises members which are first, second and third arms, wherein each arm extends from a rear face of the drawer front rearwardly in the direction of sliding of the drawer.

In a form of this embodiment, the arms further extend transversely of the direction of sliding of the drawer to meet adjacent to the rear of the drawer. In particular, the arms are so arranged that they conform to the outside of the receptacle, so that they hold the receptacle. In one form of this embodiment, the cage-like container part has no members extending transversely across the bottom of the container part.

Suitably, when the front is planar and rectangular, the first arm extends from a point adjacent the bottom edge of the drawer front, e.g. at or near the centre of the bottom edge, and the second and third arms extend from a position adjacent the top right and left hand corners of the drawer front respectively.

Aptly, each arm comprises a C-shaped channel and the chassis comprises three runners, each in a position corresponding to one of the first, second and third arms, wherein each of the C-shaped channels slots and runs over a corresponding runner, optionally with rolling means between the arm and the channel.

Aptly, the C-shaped channel of the first arm lies in one plane and the C-shaped channel of each of the other arms lies in a another plane, perpendicular to the first plane.

Each runner aptly comprises first and second members, wherein the first member is mounted on the chassis, extending rearwardly in the direction of sliding of the drawer from the front of the module and the second member loosely conforms internally to the outside of the first member and is held captive by a C-shaped channel that slots and runs over the corresponding runner second member.

This arrangement allows the runner to float within controlled limits to take up any inaccuracies in the cage-like container part.

Drawer runners usually tend to be rigid in one direction only. Thus, each of the runners in a lateral position corresponding to one of the second and third arms, and over which each of the C-shaped channels slots and runs, are rigid to vertical motion but not lateral.

The bottom runner in a position corresponding to the first arm, and over which the C-shaped channels slots and runs, is rigid to lateral motion but not vertical. The bottom runner makes the top runners more rigid laterally and the top runners make the bottom runner more rigid vertically.

The perpendicular relationship of the first channel and the second and third channels and between the corresponding runners gives rise to a triangulated structure, which means that the drawer is stable when it is slid in and out and prevented from rocking or rotating, and which prevents runners binding, e.g. a pair of lower runners and channels in parallel with a pair of upper runners and channels preventing the latter from running smoothly, or vice versa.

In a form of this embodiment, the receptacle has an open-top generally cuboidal box-shaped structure, optionally splaying slightly on all sides in the direction of the top side of the chassis, and a projecting lip extending in a generally horizontal direction on all sides from the top of the receptacle, by which it is supported solely on the second and third arms extending from a rear face of the drawer front rearwardly in the direction of sliding of the drawer, and not on the first arm towards the bottom of the chassis.

In a module of the present invention which has a drawer, the compacting operation is carried out when the drawer is slid fully into the module.

The drawer may be so constructed that it is able to withstand the forces on the waste being compacted in the receptacle in the compacting operation.

Aptly, however, the module comprises at least one load bearing member, e.g. in the form of a support beam, bar or rail, but aptly a plate or lamina, which supports the receptacle and/or the container part when the drawer is slid in fully.

Aptly, the module has a chassis and the at least one load bearing member is mounted on or part of the chassis. In a form of this embodiment, the at least one load bearing member is so positioned that when the drawer is fully slid in, it supports the receptacle clear of the container part.

The load bearing member or members may have any position or orientation that is compatible with the supporting role.

It will be seen that where the container part is a cage-like structure, the load bearing member or members should not foul any of the container part members as the drawer is slid in.

It will also be seen that at least part of the receptacle should project downwardly clear of the container part and be so positioned that, when the drawer is slid in, the receptacle may engage the load bearing member, and the latter may support the receptacle.

Aptly, the receptacle and/or the container part, in particular the receptacle has rolling means, such as wheels or rollers, mounted in or on its bottom, aptly symmetrically about the longitudinal axis of the receptacle in the direction of sliding of the drawer.

Where the receptacle has an open-top generally cuboidal box-shaped structure, optionally splaying slightly on all sides in the direction of the top side of the chassis, and a rectangular bottom which extends in a generally horizontal direction, the rolling means are aptly mounted adjacent to the corners of the bottom and projecting downwardly clear of the container part to engage the load bearing member or members when the drawer is slid in.

In a form of this embodiment, the front and rear pairs of rolling means, such as wheels or rollers, are not in register in the direction of sliding of the drawer.

In a form, the cage-like container part comprises members which are first, second and third arms, wherein each arm extends from a rear face of the drawer front rearwardly in the direction of sliding of the drawer, and the first arm extends from a point adjacent the bottom edge of the drawer front, aptly at or near the centre of the bottom edge, and the second and third arms extend from a position adjacent the top right and left hand corners of the drawer front respectively. The cage-like container part has no members extending transversely across the bottom of the container part.

In such a form, the bottom of the receptacle, which extends in a generally horizontal direction, aptly has a recess which rests on the first arm such that the majority of the bottom of the receptacle to either side of the recess, including any rolling means aptly mounted adjacent to the corners of a rectangular bottom, projects downwardly below the first arm, such that it may engage the load bearing member or members when the drawer is slid in.

Where the cage-like container comprises a first arm extending from a point adjacent the bottom edge of the drawer front, aptly at or near the centre of the bottom edge, the module may suitably comprises at least one load bearing member at the bottom of the module which extend from front to back underneath the cage-like container when the drawer is slid in. In an embodiment, the cage-like container part comprises members which are first, second and third arms, wherein each arm extends from a rear face of the drawer front rearwardly in the direction of sliding of the drawer.

Aptly, each arm comprises a C-shaped channel and the chassis comprises three runners, each in a position corresponding to one of the first, second and third arms, wherein each of the C-shaped channels slots and runs over a corresponding runner, optionally with rolling means between the arm and the channel. The at least one load bearing member is disposed on each side of the first arm of the container part, aptly symmetrically to ensure even load distribution during the compaction process.

In a form of this embodiment, a single load bearing member is mounted on, and extends over most of the bottom of the module.

The runner in a position corresponding to the first arm, and over which the C-shaped channel of that arm slots and runs, is mounted on the single load bearing member, which is disposed and extends on each side of the first arm of the container part, aptly symmetrically.

In an alternative form the cage-like container comprises two or more such arms extending from points adjacent the bottom edge of the drawer front. The module then may suitably comprises at least one load bearing member at the bottom of the module which extend from front to back underneath the cage-like container, and the at least one load bearing member is disposed between these arms of the container part. Where there are three or more load bearing members, some may also be on the sides of the arms not lying between any arms. Aptly, they are disposed symmetrically to ensure even load distribution during the compaction process.

In an embodiment, the at least one load bearing member is so positioned that when the drawer is fully slid in, it supports the receptacle clear of the bottom of the container part.

In an embodiment, the profile from the side of each load bearing member comprises, in sequence from front to back of the module underneath the container, a first inclined part which is inclined upwardly from the front of the module towards the back, a high projecting part extending in a generally horizontal direction from front to back of the module, a second inclined part which is inclined downwardly from front to back of the module, and a low depressed part, at least part of which is nearest the back of the module.

In a form of this embodiment, where the front and rear pairs of rolling means, such as wheels or rollers, are in not in register in the direction of sliding of the drawer, the second inclined part and the low depressed part comprise first sections in the same sequence from front to back of the module which are near the front of the module and second sections which are nearest the back of the module respectively, and are not in register in the direction of sliding of the drawer.

In a form of this embodiment, the first sections of the second inclined part and the low depressed part, which are near the front of the module, are aptly in the first inclined part at or near the front edge of the bottom of the module.

As the drawer is slid in, the rear bottom edge of the receptacle, aptly rolling means, such as wheels or rollers, mounted in or on this bottom edge of the receptacle, engages the first inclined part. As the drawer is slid further in, the rear of the receptacle runs up the first inclined part so as to be lifted off the rear of the arms and starts to be supported instead by the at least one load bearing members.

The rear bottom edge of the receptacle, or aptly the rolling means, such as wheels or rollers mounted in or on this edge, then runs over the high projection part, and the front bottom edge of the receptacle, or aptly the rolling means, such as wheels or rollers mounted in or on this edge, then engages the first inclined part. As the drawer is slid further in, the front of the receptacle and/or the rolling means, such as wheels or rollers, mounted therein or thereon, then runs up the first incline. As the drawer is slid further in, the rear bottom edge of the receptacle and/or the rolling means, such as wheels or rollers, mounted therein or thereon, then runs down at least a section of the second incline where it comes to rest on at least a section of the low depressed part.

In a form of this embodiment, the low depressed part, and optionally the second inclined part, comprise first sections in the same sequence from front to back of the module which are near the front of the module and second sections which are nearest the back of the module respectively. The respective first and second sections are not in register in the direction of sliding of the drawer. Aptly, the first sections of the low depressed part, and optionally of the second inclined part. are in the first inclined part at or near the front edge of the bottom of the module.

In this form, the rear bottom edge of the receptacle and/or the rolling means, such as wheels or rollers, mounted therein or thereon, runs down the second section of the second incline and comes to rest on the second section of the low depressed part.

At the same time, the front bottom edge of the receptacle and/or the rolling means, such as wheels or rollers, mounted therein or thereon, runs down the optional first section of the second incline (if present) and comes to rest on the first section of the low depressed part.

The load of the receptacle is then completely taken by the load bearing members and no longer by the first arm. The short incline part and the low depressed part are aptly in the form of depressions, such as niches, recesses or slots, which are capable of receiving the rolling means, such as wheels or rollers mounted in or on the edges of the receptacle, keeping the receptacle in place during waste compaction.

In an embodiment, at the line adjacent to the front bottom edge of the module where the profile of the or each load bearing member changes from the first inclined part which is inclined upwardly from the front of the module towards the back to the high projecting part extending in a generally horizontal direction from front to back of the module, the or each load bearing member has rolling means, such as wheels or rollers, mounted in or on it along and at right angles to the line. Aptly a pair of rolling means, such as wheels or rollers, is mounted symmetrically about the runner corresponding to the first arm, and over which the C-shaped channel of that arm slots and runs, and are mounted in a pair of depressions, such as niches, recesses or slots, such that the rolling means projects upwardly of the load bearing member to each side of the runner, so that it may engage the bottom of the receptacle and ease the passage of the drawer as it is slid in. This pair of rolling means is not in register in the direction of sliding of the drawer with the pairs of rolling means, such as wheels or rollers, in or on the receptacle.

The drive means may be operated manually, for example by a conventional lever pivotally attached to a fixed part of the module and to the compacting plate.

Aptly, however, the device comprises non-manual drive means for driving the movement of the compacting plate during the compacting operation. Aptly, the drive means comprises a reciprocating drive shaft operably connected to the compacting plate. The drive means aptly comprises a linear ram, which is an electrically powered device, connected to a linearly acting drive shaft.

This novel use of a linear ram in domestic appliances is particularly advantageous, as linear rams are sealed units, operate over a long life, allow easy replacement and reduce the need for significant control electronics.

Alternatively, the drive shaft may be moved by a hydraulic ram.

Aptly, the module has a scissor jack-type mechanism operably connecting the drive means to the compacting plate. The drive means acts on the scissor jack-type mechanism thereby to drive the plate during a compacting and withdrawing operation. A scissor jack-type mechanism comprises a generally planar framework of pivotally joined members, for example defining at least one right parallelogram with an operational axis along a diagonal of the parallelogram, such that a force with a component applied to the framework transversely to the operational axis to compress the parallelogram in that direction extends it along the operational axis, and vice versa.

Aptly, the scissor jack-type mechanism comprises at least two such frameworks lying in mutually parallel planes.

The scissor jack-type mechanism usually has an upright operational axis, operably connecting the drive means to the compacting plate, thereby to drive the compacting plate downwards during compaction. Such a scissor jack-type mechanism aptly comprises at least two planar frameworks of pivotally joined members, each defining at least one right parallelogram with an operational axis along a diagonal of the parallelogram, lying in mutually parallel planes.

Such a mechanism usually comprises a, aptly rectangular, bottom plate to which the compacting plate is attached, and which extends in a generally horizontal direction.

Alternatively, the bottom plate of the scissor jack mechanism may be the compacting plate.

The mechanism also usually comprises a, aptly rectangular, top plate, which also extends in a generally horizontal direction which abuts the top inside surface of the chassis of the module.

Thus, the top inside surface of the chassis of the module takes the upward reactive thrust on the scissor jack mechanism when, during a compacting operation, the linear ram drives the compacting plate downwards during compaction.

The uppermost members of each framework are connected to the top plate of the scissor jack mechanism, usually respectively pivotally attached at a pivot point and to a follower pin slidably mounted in a retaining depression, such as a C-section niche or recess, or a slot, such that the pin shank projects to serve as a pivot and the pin head is retained by and runs in the retaining depression.

The lowermost members of each framework are connected to the bottom plate of the scissor jack mechanism, again respectively pivotally attached at a pivot point and to a follower pin slidably mounted in a retaining depression, such as a C-section niche or recess, or a slot, such that the pin shank projects to serve as a pivot and the pin head is retained by and runs in the retaining depression.

Such an embodiment of a scissor jack-type mechanism with an upright operational axis will thus often have a generally cuboidal structure. In one embodiment, the mechanism is elongate from the front to the rear in the module, and is slidably mounted as a pull-out insert in the module, and is slidable in and out of the front of the chassis to and from the rear of the chassis in a generally horizontal direction corresponding to its longitudinal axis.

It may conveniently be slidably mounted in the chassis by means of, e.g. a pair of opposed flanges laterally extending in a generally horizontal direction and often running from front to back over most of the length of the scissor jack mechanism. The top surfaces of a co-operating pair of opposed flanges mounted on the chassis within the module, which extend towards the scissor jack-type mechanism and in a direction to and from the rear of the chassis and in a generally horizontal direction, are vertically in register with and slidably engage the bottom surfaces of the of the first pair of opposed flanges.

Pairs of rolling means may optionally be mounted between the co-operating pairs of opposed flanges to ease the passage of the scissor jack mechanism as it is slid in. Pull-out means, such as handles, may be fixed on the front of the scissor jack mechanism, for example at each side.

Aptly, the drive means comprises a linear ram having a reciprocating drive shaft, wherein the drive shaft is connected to the scissor jack-type mechanism, and the scissor jack-type mechanism is connected to the compaction plate.

As noted hereinbefore, aptly the module comprises a drawer which slidably mounted in the module and may thus be slid relative to a fixed or pivoted drive means.

Aptly, the drive means is fixedly or pivotally mounted above the drawer, and during a compacting operation, the drive means drives the compacting plate downwardly into the receptacle.

In such an embodiment, the compacting plate should in its rest position before the compacting operation be clear of the receptacle.

Aptly the module has a scissor jack-type mechanism with an upright operational axis, operably connecting the drive means to the compacting plate, thereby to drive the compacting plate downwards during a compacting operation and upwards during a withdrawing operation.

Aptly, the scissor jack-type mechanism comprises at least two such frameworks lying in mutually parallel planes, each connected to the compacting plate.

As noted hereinbefore, aptly, the drive means comprises a reciprocating drive shaft operably connected to the compacting plate through a scissor jack-type mechanism, and for example a linear ram connected to a linearly acting drive shaft with a drive shaft operational axis.

The drive means may have any position or orientation that is compatible with the driving role. For example, a linear drive shaft connected to a linear ram and to a upright scissor jack-type mechanism may have an upright drive shaft operational axis.

However, it is convenient to have the drive shaft operational axis substantially inclined from the upright, for example at an angle between 10° and 60°, such as 20° and 50° in its rest position before the compacting operation with the compacting plate clear of the receptacle. This arrangement produces a more compact overall drive means.

The drive means aptly lies between two mutually parallel frameworks of a scissor jack-type mechanism as described in relation to corresponding integers of the module hereinbefore.

Similarly, a linear drive shaft connected to a linear ram and to a scissor jack-type mechanism may have a drive shaft operational axis extending transversely to the direction of sliding of the drawer. Aptly, the drawer is elongate in the direction of sliding of the drawer, and it is more convenient to have the generally elongate drive shaft and linear ram, and hence the drive shaft operational axis run generally in the direction of sliding of the drawer.

Where the drive means lies between two mutually parallel frameworks of a scissor jack-type mechanism, the planes of the frameworks will also lie in the direction of sliding of the drawer. Again, this produces a more compact overall drive means.

In the event that the drive means that is electrically powered, such as a linear ram, control electronics for the drive means are also housed in the compacting module.

The control electronics may include an initiation switch whose operation initiates a compacting operation.

The switch may be operated directly by a user or may be operated indirectly as a result of some other operation by a user. For instance, in the case where the compacting module comprises a drawer, the initiation switch may be operated by the drawer itself, when it reaches its fully closed position.

Similarly, the control electronics may include a switch operated directly by a user, or operated indirectly as a result of some other operation by a user, that switches the drive means so that it moves the compacting plate between a number of positions or retracts it until it regains its rest position.

For instance, in the case where the compacting module comprises a drawer front, a sensor switch that switches the drive means so that it moves the compacting plate to regain its rest position may be provided.

Such a sensor switch will be so positioned to do so when the drawer is opened by the user when the compacting plate is extended to a position or up to its maximum extension in the receptacle. A sensor switch may switch the drive means so that it moves the compacting plate between a number of positions or retracts it until it regains its rest position. The receptacle is then ready to receive more waste for compaction.

The compacting operation may involve driving the compacting plate to a first position in the receptacle, withdrawing the plate and driving the plate to a second position in the receptacle, further into the receptacle than the first position.

The driving means may drive the plate to the first position at a first power level and to the second position at a second power level. The second power level may be higher than the first power level.

The compacting operation may alternatively involve driving the plate to a first position in the receptacle, withdrawing the plate to a second position in the receptacle, holding the plate at the second position for a predetermined period of time, and withdrawing the plate altogether from the receptacle.

For example, the drive means can be commanded to undergo any one of three routines. A first routine involves the compacting plate extending into the receptacle to up to the maximum extension and retracting completely when it has reached the maximum extension.

The second routine involves the compacting plate extending e.g. to 80% of its maximum extension, retracting and then extending to 100% of its maximum extension.

The purpose of the second routine is to prevent straining the linear ram in the event the receptacle is quite full with recyclable waste material. In effect, the material is compacted stage-wise in two stages: an initial, partial compacting stage; and, a final, complete compacting pass.

The third routine involves the compacting plate extending to 100% of it maximum extension, retracting to e.g. 80% of its maximum extension and pausing there for a predetermined time or until the user opens the drawer and the compacting plate retracts.

The purpose of the third routine is to deal with recyclable waste materials such as plastics that have a "memory" or a tendency to attempt to resume their original shape after initial compaction. By retracting to e.g. 80% of its maximum extension following the main compacting extension, the compacting plate keeps the waste material compacted, preventing it from resuming its original shape. The pause time is determined to be the amount of time required for the waste material to "lose" its "memory".

The control electronics aptly comprise jam and overload detection, and failsafe switching to halt the compacting process.

The receptacle may suitably have a rest position capacity in the range of 10 to 40 l, for example about 26 l.

The receptacle may suitably have a compaction ratio in the range of 4:1 to 6:1, for example about 5:1, where the compaction ratio is the ratio of the volume the receptacle before the compacting operation and the same volume below the compacting plate after full extension of the drive means operably connected to the compacting plate.

The compacting cycle, i.e. the time between the compacting plate leaving and regaining its rest position may suitably be in the range of 10 to 40 seconds, e.g. 15 to 30 seconds, depending on the crush routine used, unless the user intervenes or the third routine is activated, i.e. the compacting plate being extended to 100% of it maximum extension, retracted to e.g. 80% of its maximum extension and paused there for a predetermined period, to deal with recyclable waste materials such as plastics that have a "memory" or a tendency to resume their original shape after initial compaction.

The drive means, in particular when it comprises a linear ram may suitably exert a full compacting force in the range of 200 to 600 kg, e.g. 300 to 500 kg.

The module is aptly constructed of plastics materials, such as high density polypropylene, on a galvanised steel chassis, for lightness, speed of replacement if damaged, and lower cost.

The module may serve as a stand-alone compacting and storing module for paper, cardboard cartons or cardboard or plastics material containers. In an alternative embodiment, the module may suitably comprise a cuboidal chassis, and the drive means of the compacting and storing module for paper, cardboard cartons or cardboard or plastics material containers is aptly mounted in, and adjacent to a top side edge of, the chassis, extending rearwardly in the direction of sliding of the drawer from the front of the chassis.

In this alternative embodiment, the module may suitably also comprise a crushing unit, of the type described in our copending application, comprising a drawer and a can crushing device, wherein the can crushing device is mounted in the drawer.

A can crushing device is mounted in the drawer, and comprises an elongate crushing compartment. A can is crushed by placing it in the crushing compartment and reducing the size of the crushing compartment, thereby subjecting the can to a crushing operation. The compartment aptly has a slot through which a crushed can may drop under gravity, with the slot so positioned that the crushed can drops into a storage box.

In this form of the embodiment, the drive means of the compacting and storing module for paper, cardboard cartons or cardboard or plastics material containers is mounted in, and adjacent to the other top side edge of, the chassis than that where the crushing unit is mounted, and also extends rearwardly in the direction of sliding of the crushing unit drawer from the front of the chassis.

In this form of the embodiment, the crushing unit is mounted in, and adjacent to the other top side edge of, the chassis than that where the drive means of the compacting and storing module for paper, cardboard cartons or cardboard or plastics material containers is mounted. The crushing unit also extends rearwardly in the direction of sliding of the crushing unit drawer from the front of the chassis.

Aptly the compacting drive means and the crushing unit abut each other laterally. Although each component of the module performs different functions, it is then convenient to have the compacting drive means and the crushing unit share a common storage unit, mounted in the module on the chassis, and positioned below the crushing unit and the compacting drive means, such that a crushed can drops into it and other recyclable waste materials put into it may be subjected to a compacting operation.

As noted above, the crushing compartment may include a slot adjacent to the first fixed end wall through which a crushed can may drop under gravity, and in the rest position of both, the receptacle is positioned underneath the slot in the crushing unit compartment. The compacting plate extends in a generally horizontal direction under the crushing unit and the compacting drive means, but in this form of the embodiment, it only extends forwards in the direction of sliding of the crushing unit drawer from the rear of the chassis for its front edge to overlap the rear part of the slot in the crushing unit compartment and to define a space behind the receptacle drawer front.

The crushing compartment is slidable out of the front of the chassis from the rear of the chassis in a direction generally corresponding to its elongate dimension after a crushing operation (during which the crushing unit drawer is closed).

A crushed can will be retained in the slot adjacent to the first fixed end wall by the compacting plate until withdrawal of the crushing unit, when the slot clears the front edge of the compacting plate, so that a crushed can drops under gravity through the space in front of the compacting plate into the receptacle.

Suitable storage units include the embodiment of a storage unit drawer described hereinbefore, in which the drawer has a front mounted on a container part, and a receptacle is slidably locatable and sits in the drawer container part. The container part aptly conforms to the receptacle, so that it holds the receptacle. Often the receptacle is elongate from the front to the rear. Often the receptacle is in the form of an open-top generally cuboidal box-shaped structure, splaying slightly on all sides in the direction of the top side of the chassis, and is smaller than the container part.

Often the receptacle has a pull-out insert which conforms at least in part to the receptacle, sits in the receptacle and is slidable upwardly out of the receptacle. Where the receptacle is in the form of an open-top generally cuboidal box-shaped structure, the pull-out insert conforms at least to the bottom and each side of the receptacle. It conveniently has lifting means, such as handles, for example at each side.

The container part may be an open framework, e.g. it may have a cage-like structure formed by intersecting members. As noted hereinbefore, the drawer front is suitably planar, and aptly rectangular, and aptly, the cage-like container part comprises members which are first, second and third arms, wherein each arm extends from a rear face of the drawer front rearwardly in the direction of sliding of the drawer. In a form of this embodiment, the arms further extend transversely of the direction of sliding of the drawer to meet adjacent to the rear of the drawer. In particular, the arms are so arranged that they conform to the outside of the receptacle, so that they hold the receptacle. In a form of this embodiment, the cage-like container part has a first arm in perpendicular relationship with second and third arms to give stability.

The module may serve as an appliance in its own right or may be combined with one or more other modules to form an integrated appliance. For instance, another module in such a combination of modules may be a can crushing and storing module for metal food and drinks containers; and yet another module could store glass. The same module design can be used in either mode without adaptation.

Referring to the embodiment of the compacting module which uses a linear ram to drive the compacting plate, a linear ram has not been used hitherto in a domestic waste compacting unit.

Accordingly, in a second aspect the invention provides a packaging, carton and container compacting and storing module comprising a receptacle, and drive means and a compacting plate, wherein the drive means is operably connected to the drive means and, during a compacting operation, the drive means drives the compacting plate into the receptacle, and wherein the drive means comprises a linear ram.

Embodiments of this module and its components are as so described in relation to corresponding integers in relation to the general module hereinbefore.

In some embodiments, the drive means for the compacting plate moves the drive shaft by means of a screw thread drive, which may the may tend to put a rotational motion on the drive shaft and hence on the compacting plate. A receptacle with a rectangular cross-section and a complementarily shaped compacting plate ensures that the compacting plate cannot rotate during a compacting operation.

Alternatively, the linear ram may be operably connected to the compacting plate through a scissor jack-type mechanism.

BRIEF DESCRIPTION OF THE DRAWINGS

The present invention will now be described hereinafter, by way of example only, with reference to the following Figures, in which.

DETAILED DESCRIPTION OF THE INVENTION

Figure 1:
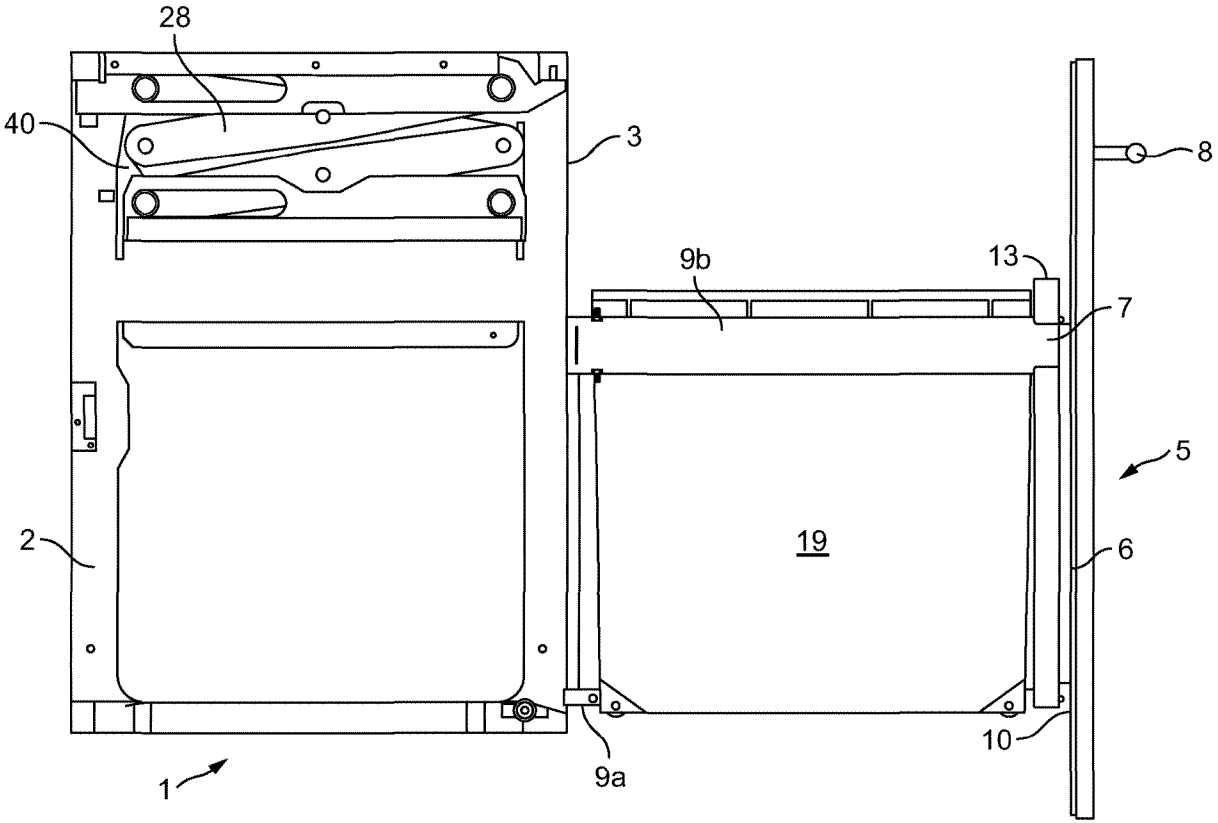
FIG. 1 shows a side cross-sectional view of a waste compacting and storing module according to the present invention, with the storage unit drawer fully pulled out.
Figure 2B:
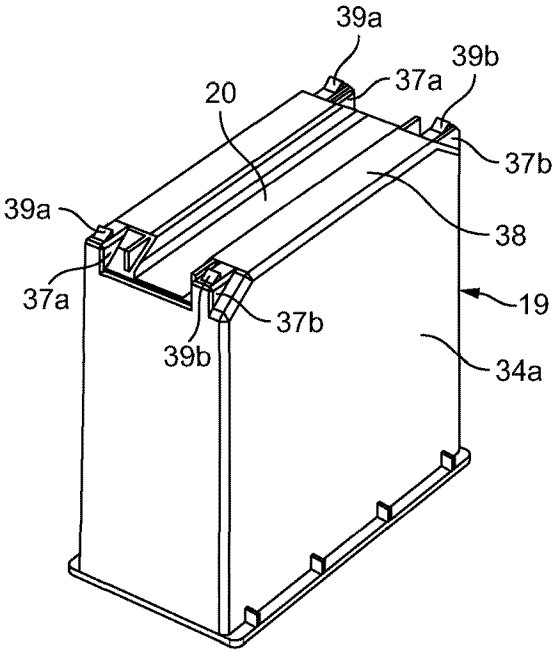
FIGS. 2*a* and 2*b* show isometric views of the chassis and the underside of the storage unit drawer of waste compacting and storing module of FIG. 1.
Figure 2A:
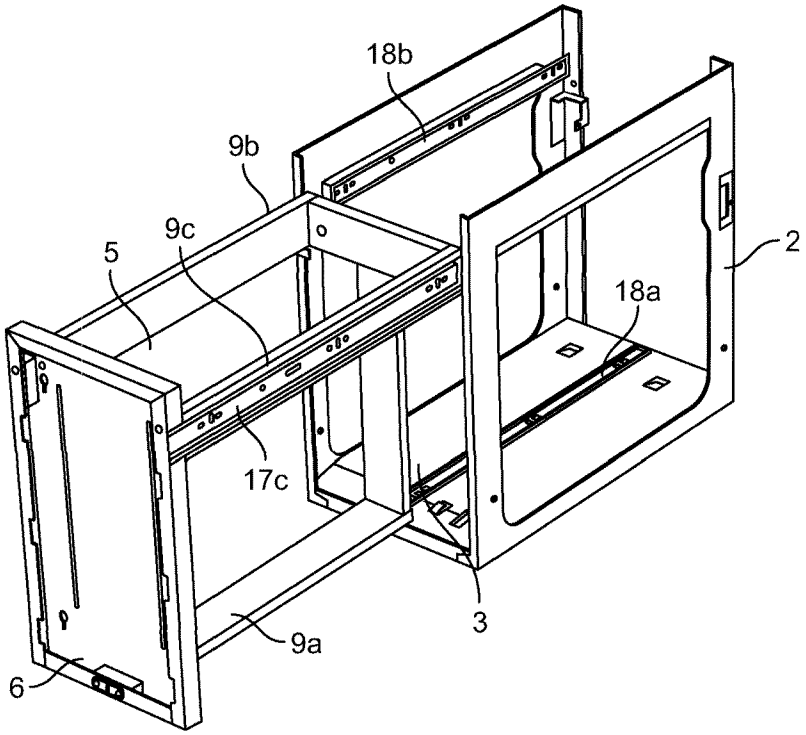

Referring to FIGS. 1 and 2, a packaging, carton and container compacting and storing module 1 has a chassis 2 comprising a framework consisting of metal structural members defining a cuboidal box-shaped space.

The space is enclosed on all sides apart from the forward facing side 3 by a polypropylene skin 4 (not shown). The module 1 has a drawer 5 comprising a front 6 and a cage-like container part 7. The drawer 5 slides in and out of the space. The front 6 covers the whole of the forward facing side 3 of the space. A handle 8 is fixed on the front 6.

Figure 3B:
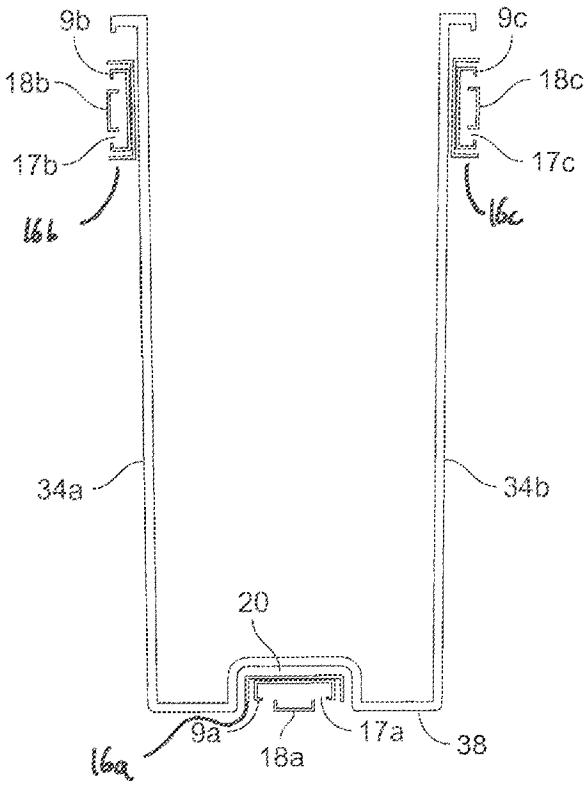
FIGS. 3*a* and 3*b* show an exploded isometric view of the storage unit drawer within the waste compacting and storing module of FIG. 1, and its cage-like container part, and a frontal cross-sectional view of the receptacle of the storage unit drawer, held by three arms of the container part.
Figure 3A:
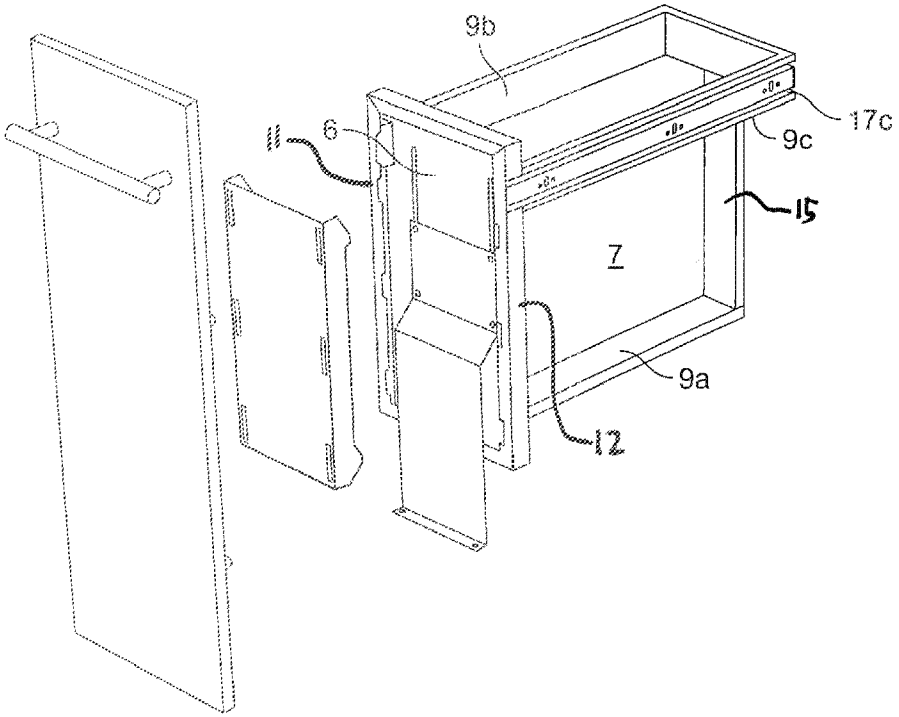

Referring also to FIG. 3, in the compacting and storing module 1, the cage-like container part 7 is elongate from the front to the rear, and as part of the drawer 5 is slidable in and out of the front of the chassis 2 to and from the rear of the chassis 2 in a direction generally corresponding to its elongate dimension.

The cage-like container part 7 comprises three arms 9*a*, 9*b*, 9*c* that extend from the inside face of the drawer front 6 in the sliding-in direction of the drawer 5.

The first arm 9*a* extends from a position on the inside surface of the drawer front 6, adjacent the lower edge 10 of the drawer front 6, approximately midway between the right- and left-hand edges 11, 12 of the drawer front 6.

The second and third arms 9*b*, 9*c* each extend from a position adjacent to the top right- and left-hand corners 13, 14 of the inside surface of the drawer front 6 respectively. The three arms 9*a*, 9*b*, 9*c* are slightly shorter than the depth of the space and are interconnected at their ends remote from the drawer 5 front 6 by an integral T-piece 15.

Each arm 9*a*, 9*b*, 9*c* comprises an inner, box-section part 16*a*, 16*b*, 16*c* and an outer C-shaped channel part 17*a*, 17*b*, 17*c*. The channel opening of each arm 9*a*, 9*b*, 9*c* faces outwards towards the polypropylene skin 4. The first arm channel opening faces downwards and the plane of the mid-section of the C-channel 17*a* is horizontal; the second and third arm channel openings each face sideways to different sides, and the planes of the mid-sections of their C-channels 17*b*, 17*c* are vertical. Hence, the planes of the first arm channel 17*a* and the second and third arm channels 17*b*, 17*c* are perpendicular.

The chassis 2 also comprises three runner members 18*a*, 18*b*, 18*c* each of which is fixed to the chassis in a position corresponding to the positions of one of the first, second and third arms 9*a*, 9*b*, 9*c* of the drawer 5.

Each C-shaped channel 17*a*, 17*b*, 17*c* slots onto the corresponding one of the runners 18*a*, 18*b*, 18*c*, and the channels 17*a*, 17*b*, 17*c* are able to run back and forth on the runners 18*a*, 18*b*, 18*c* so as to enable the drawer 5 to be slid in and out.

Each runner 18*a*, 18*b*, 18*c* comprises first and second members (not shown), wherein the first member is mounted on the chassis 3, extending rearwardly in the direction of sliding of the drawer 5 from the front of the module 1 and the second member loosely conforms internally to the outside of the first member and is held captive by a C-shaped channel, respectively 17*a*, 17*b*, 17*c*, that slots and runs over the corresponding runner second member. This arrangement allows each runner 18*a*, 18*b*, 18*c* to float within controlled limits to take up any inaccuracies in the cage-like container part 7.

Drawer runners usually tend to be rigid in one direction only. Thus, each of the runners 18*b*, 18*c* in a lateral position corresponding to one of the second and third arms 9*b*, 9*c*, and over which each of the C-shaped channels 17*b*, 17*c* slots and runs, are rigid to vertical motion but not lateral. The bottom runner 18*a* in a position corresponding to the first arm 9*a*, and over which the C-shaped channel 17*a* slots and runs, is rigid to lateral motion but not vertical. The bottom runner 18*a* makes the top runners 18*b*, 18*c* more rigid laterally and the top runners 18*b*, 18*c* make the bottom runner 18*a* more rigid vertically.

The perpendicular relationship of the first channel 17*a* and second and third channels 17*b* and 17*c* and between the corresponding runners 18*a*, 18*b*, 18*c* means that the drawer 5 is stable when it is slid in and out and prevented from rocking or rotating.

An open-toped receptacle 19 is elongate from the front to the rear, and is in the form of an open-top generally cuboidal box-shaped structure, splaying slightly on all sides in the direction of the top side of the chassis, and is smaller than, conforms to, is received in, and is slidable upwardly out of, the cage-like container part 7.

The receptacle 19 has a projecting lip 69 extending in a generally horizontal direction on all sides from the top of the receptacle 19, by which it is supported solely on the second and third arms 9*b*, 9*c*, extending from a rear face 10 of the drawer front 6 rearwardly in the direction of sliding of the drawer 5, and not on the first arm 9*a* towards the bottom of the chassis 2.

The receptacle 19 is used for storing recyclable waste material. Any such material may be deposited in the receptacle 19 by a user when the drawer 5 is slid open.

Figure 4:
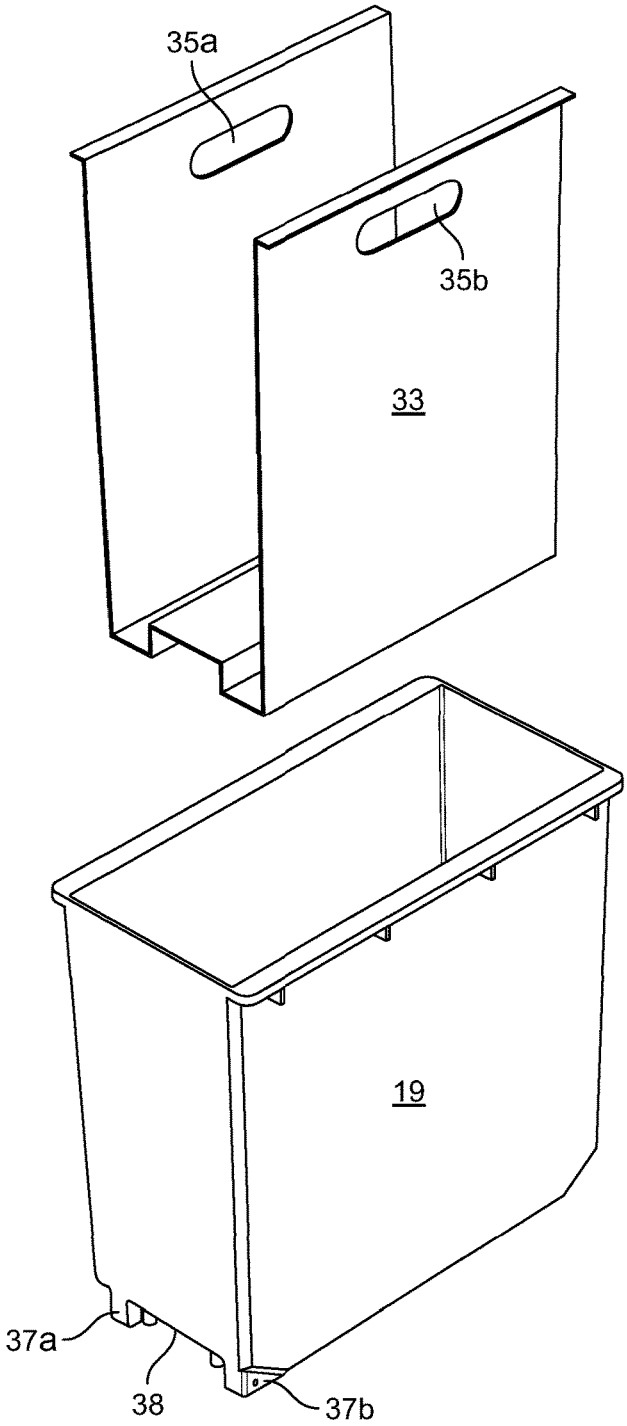
FIG. 4 shows an exploded isometric view of the storage unit drawer receptacle of the storage unit drawer of the waste compacting and storing module of FIG. 1, and its pull-out insert.

Referring also to FIG. 4, the receptacle 19 has a pull-out insert 33, which conforms to the sides 34*a*, 34*b* and bottom 38 of the receptacle 19, sits in the receptacle 19, and is slidable upwardly out of the receptacle. It has lifting means, here slot handles 35*a*, 35*b* on each side. Following a compacting operation, the pull-out insert 33 aids in the removal of recyclable waste compacted by the action of the compacting means from the receptacle.

Figure 5:
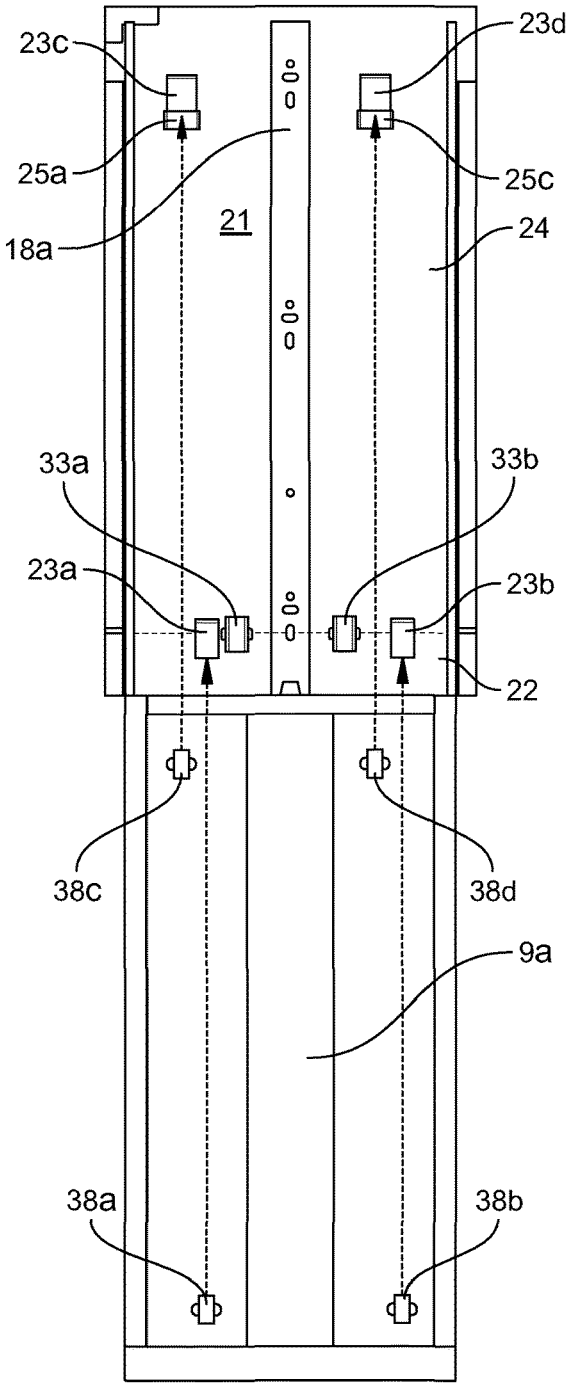
FIG. 5 shows a plan cross-sectional view near the bottom storage unit drawer of the drawer of the waste compacting and storing module of FIG. 1, and the bottom of the chassis, positioned below the drawer which is slid outwards of the chassis.

Referring to FIGS. 2, 4 and 5, the receptacle 19 has four pairs of trunnions 37*a*, 37*b*, 37*c*, 37*d*, each of which is in the form of an open-bottomed generally triangular prism-shaped structure, integral with the bottom 38 of the receptacle, and defining an inner space, enclosed on all sides apart from the downward facing side. The pairs 37*a*, 37*b*, 37*c*, 37*d* are adjacent to the corners of the rectangular bottom 38, and in turn form a front pair 37*a*, 37*b*, and a rear pair 37*c*, 37*d*, each of which is symmetrical about the longitudinal axis of the receptacle 19 in the direction of sliding of the drawer 5. Each of the pairs of trunnions 37*a*, 37*b* and 37*c*, 37*d* houses a front pair 38*a*, 38*b*, and a rear pair 38*c*, 38*d* of rollers, rotatably mounted in the internal space on an axle, such that the roller 39*a*, 39*b*, 39*c*, 39*d* projects downwardly clear of the cage-like container part 7. The front and rear pairs of rollers 38*a*, 38*b*, and 38*c*, 38*d* are not in register in the direction of sliding of the drawer 5.

When the drawer 5 is slid out, the receptacle 19 is supported by the second and third arms 9*b*, 9*c*.

There is a recess 20 in the bottom of the receptacle 19, running from front 6 to back along the centre, and the majority of the bottom of the receptacle 19, to either side of the recess 20, sits below the first arm 9*a*.

The first and second arms 9*a*, 9*b*, 9*c* and the T-piece 15 restrict the receptacle 19 from sideways or backwards movement respectively.

Referring to FIGS. 2 and 5, the chassis 2 in the compacting and storing module 1 further comprises a single load bearing member 21, mounted on, and attached to, the chassis 2, and extending from front to back over most of the bottom of the module 1.

The runner 18*a* in a position corresponding to the first arm 9*a* of the container part 7 and over which the C-shaped channel 17*a* of that arm 9*a* slots and runs so as to enable the drawer 5 to be slid in and out, together with the second and third channels 17*b* and 17*c*, is mounted on the single load bearing member 21, which is disposed and extends symmetrically on each side of the runner 18*a*. The load bearing member 21 is so positioned that when the drawer 5 is fully slid in, it supports the receptacle 19 clear of the bottom of the container part 7.

The profile from the side of the load bearing member 21 comprises, in sequence from front to back of the module 1 underneath the container part 7;

a first inclined part 22, which is inclined upwardly from the front of the module 1 towards the back, and extends from side to side of the module 1;

first sections 23*a*, 23*b* near the front of the module 1 of a low depressed part 23, extending in a generally horizontal direction from the front towards the back of the module 1;

a high projecting part 24 extending in a generally horizontal direction from front to back and from side to side of the module 1;

a second inclined part 25*a*, 25*b* which is inclined downwardly from the front towards the back of the module 1; and second sections 23*c*, 23*d* near the back of the module 1, of the low depressed part 23, extending in a generally horizontal direction from the front towards the back of the module 1.

The purpose of these parts is to take over supporting the receptacle 19 when the drawer 5 is fully slid into the space. The parts achieve this by lifting the receptacle 19 off of the arms 9*b*, 9*c* of the container part 7 as the drawer 5 is slid in such that the load bearing member 21 is carrying the load of the receptacle 19 and any compacting load applied to it.

The first sections 23*a*, 23*b* near the front of the module 1 of the low depressed part 23 are disposed symmetrically on each side of the runner 18*a* at the line 26 adjacent to the front bottom edge of the module 1. Along this line, where the load bearing member 21 changes from the first inclined part 22 to the high projecting part 24, the first sections 23*a*, 23*b* are in the form of niches in the first inclined part 22 and the high projecting part 24, which are in register in the direction of sliding of the drawer 5 with, and are capable of receiving, the front pair of rollers 39*a*, 39*b* of the receptacle 19.

The second inclined part 25*a*, 25*b* and the second sections 23*c*, 23*d* of the low depressed part 23, all near the back of the module 1, are in register in the direction of sliding of the drawer 5, and disposed symmetrically on each side of the runner 18*a* corresponding to the first arm 9*a*, and over which the C-shaped channel of that first arm 9*a* runs.

The second inclined part 25*a*, 25*b* and the second sections 23*c*, 23*d* of the low depressed part 23, all near the back of the module 1, are disposed symmetrically on each side of the runner 18*a* corresponding to the first arm 9*a*, and over which the C-shaped channel of that first arm 9*a* runs, and are in the form of slots in the high projecting part 24, which are in register in the direction of sliding of the drawer 5 with, and are capable of receiving, the rear pair of rollers 39*c*, 39*d* of the receptacle 19.

The second inclined part 25*a*, 25*b* and the second sections 23*c*, 23*d* of the low depressed part 23, all near the back of the module 1, are in not in register in the direction of sliding of the drawer 5 with the first sections 26*a*, 26*b* near the front of the module 1 of the low depressed part 26.

The reception of the rollers 39*a*, 39*b* and 39*c*, 39*d* of the receptacle 19 keeps the receptacle 19 in place during waste compaction.

At the line 26 adjacent to the front bottom edge of the module 1 where the load bearing member 21 changes from the first inclined part 22 to the high projecting part 24, a pair of rollers 33*a*, 33*b* is rotatably mounted on axles in a pair of recesses symmetrically about the runner 18*a* in the first inclined part 22 and the high projecting part 24, such that the rollers 33*a*, 33*b* project upwardly of the load bearing member 21 to each side of the runner.

Thus, the rollers 33*a*, 33*b* may engage the bottom 38 of the receptacle 19 and ease the passage of the drawer 5 as it is slid in. This pair of rollers 33*a*, 33*b* is not in register in the direction of sliding of the drawer 5 with any other integer.

Referring to FIGS. 1 and 6 to 11, the module 1 further comprises a compacting drive means and a compacting means, here respectively:

an electrically powered linear ram 29 which is pivotally attached to a scissor jack mechanism 28, which is slidably located and sits in a compactor compartment 40 at the top of the space enclosed by the chassis 2; and a compacting plate 27 which is attached to a bottom plate 46 of the scissor jack mechanism 28.

The mechanism 28 has two side flanges 41*a*, 41*b*, extending from front to back over most of the length of the sides of the mechanism 28, the lower surfaces of which respectively engage the upper surfaces of two side runner ledges 42*a*, 42*b*, extending in parallel with the two flanges 41*a*, 41*b* from front to back over most of the length of the compactor compartment 40, so that they locate and support the mechanism 28 in the compactor compartment 40.

Figure 11B:
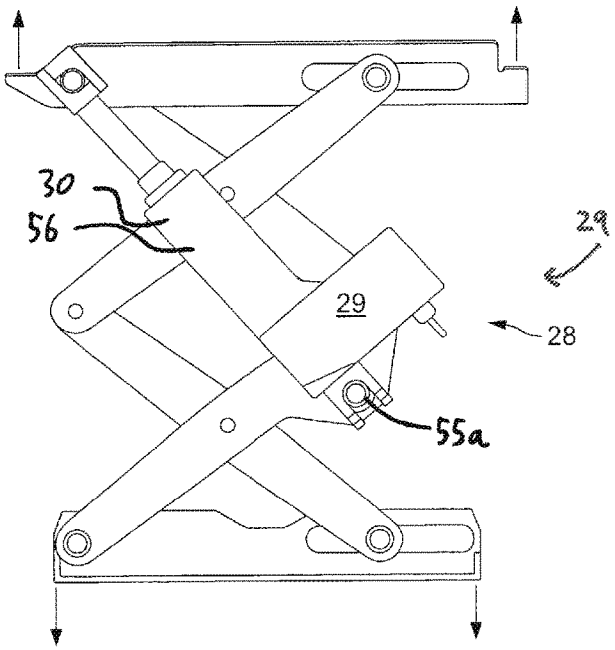
FIGS. 11*a*, 11*b* and 11*c* show an exploded isometric view of the compacting drive means waste compacting and storing module of FIG. 1, and side cross-sectional views of the compacting drive means fully retracted and extended.
Figure 11C:
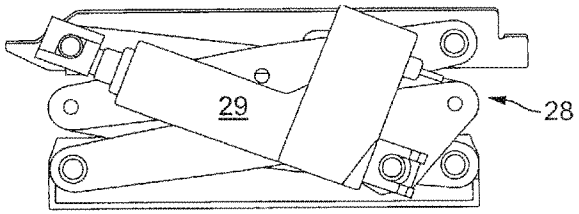
Figure 11A:
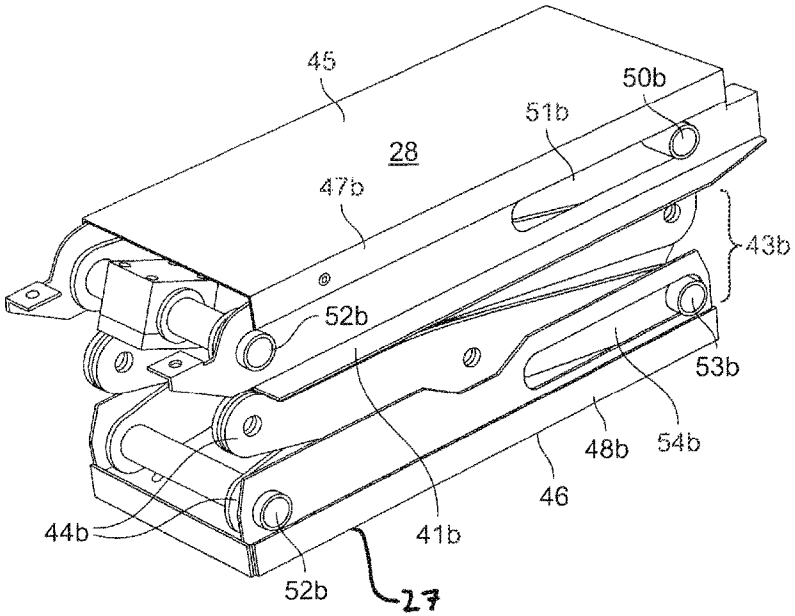

The scissor jack mechanism 28 comprises two mutually parallel frameworks 43*a*, 43*b*, as illustrated in FIG. 11, the first 43*a* positioned adjacent to the left-hand inside surface of the chassis 2, and the second 43*b* positioned adjacent to the right-hand inside surface of the chassis 2, with the planes of the frameworks lying in the direction of sliding of the drawer 5. Each framework 43*a*, 43*b* is of elongate members, collectively 44*a* and 44*b*, pivotally connected together at their ends and middles.

The mechanism 28 comprises a rectangular top plate 45 with a pair of downwardly projecting flanges 47*a*, 47*b* extending from front to back over most of the length of the scissor jack mechanism 28.

The mechanism 28 also comprises a rectangular bottom plate 46 with upwardly projecting flanges 48*a*, 48*b* extending from front to back over most of the length of the scissor jack mechanism 28.

The compacting plate 27 is attached to a bottom plate 46 of the scissor jack mechanism 28. (Alternatively, the bottom plate 46 of the scissor jack mechanism 28 may be the compacting plate 27.)

The top plate 45 abuts the top inside surfaces of the chassis 2, and the latter take the upward reactive thrust on the scissor jack mechanism 28 when, during a compacting operation, the linear ram 29 drives the compacting plate 27 into the receptacle 19.

The uppermost members of each framework 43*a*, 43*b*, as illustrated in FIG. 11 are connected to the downwardly projecting flanges 47*a*, 47*b* of the top plate 45 of the scissor jack mechanism 28, respectively pivotally attached at a pivot point 49*a*, 49*b* and by a follower pin 50*a*, 50*b* slidably located and running in a slot 51*a*, 51*b*.

The lowermost members of each framework 43*a*, 43*b*, as illustrated in FIG. 11 are connected to the upwardly projecting flanges 48*a*, 48*b* of the bottom plate 48 of the scissor jack mechanism 28, respectively pivotally attached at a pivot point 52*a*, 52*b* and by a follower pin 53*a*, 53*b* slidably located and running in a slot 54*a*, 54*b*.

The plate 27 is driven between the high and low positions by the action of a linear ram 29 which is an electrically powered device with a reciprocating drive shaft 30. The linear ram 29 lies between the two mutually parallel frameworks 43*a*, 43*b*, of the scissor jack mechanism 28, and like the planes of the frameworks 43*a*, 43*b*, the linear ram 29 lies in a plane in the direction of sliding of the drawer 5. The free end of the drive shaft 30 is pivotally attached at the pivot point 49*a* to the downwardly projecting flange 47*a* of the top plate 45 of the scissor jack mechanism 28. The body 56 of the ram 29 is pivotally attached to a middle pivot point 55*a* of the scissor jack mechanism 28. The extension of the drive shaft 30 from the body 56 of the ram 29 is thus translated into extension of the scissor mechanism 28, and, as a result the compacting plate 27 is driven downwards.

The linear ram 29 and its drive shaft 30 in their rest position before the compacting operation lie at an angle of about 60° to the upright, and the plate 27 in its corresponding high position is clear of the receptacle.

The extendability of the scissor jack mechanism 28 is such that, when the cage-like container part 7 containing a receptacle 19 is fully slid into the module 1, the scissor jack mechanism 28 is extendable to drive the compacting plate 27 from its high position clear of the receptacle 19 to a low position inside the receptacle 19 close to the bottom of the receptacle 19. The plate 27 is sized so that there is minimal clearance between the edges of the plate 27 and the sides of the receptacle 19. At full extension of the scissor jack mechanism 28 in the compacting operation to drive the compacting plate 27 from its high position clear of the receptacle 19 to a low position inside the receptacle 19 close to the bottom of the receptacle 19, the linear ram 29 and its drive shaft 30 in that position lie at an angle of about 45° to the upright.

The linear ram 29 is controlled by control electronics 31 (not shown) housed within the space. The control electronics 31 are activated by a user initiation switch 32. When the user switch 32 is operated, the control electronics 31 command the linear ram 29 to drive the compacting plate 27 down into the receptacle 19, thereby to apply a compacting force to any recyclable waste material deposited in the receptacle 19 and to compact it.

The linear ram 29 can be commanded to undergo any number of routines, here any one of three routines;

A first routine involves the compacting plate 27 extending into the receptacle 19 to up to the maximum extension and retracting completely when it has reached the maximum extension.

The second routine involves the compacting plate 27 extending 80% of its maximum extension, retracting and then extending to 100% of its maximum extension.

The purpose of the second routine is to prevent straining the linear ram 29 in the event the receptacle 19 is quite full with recyclable waste material.

The third routine involves the compacting plate 27 extending to 100% of its maxium extension, retracting to 80% of its maximum extension and pausing there for a predetermined time before fully retracting.

In effect, the material is compacted stage-wise in two stages: an initial, partial compacting stage; and, a final, complete compacting pass.

The purpose of the third routine is to deal with recyclable waste materials that have a "memory" or a tendency to resume their original shape after initial compaction. By retracting to 80% of its maximum extension following the main compacting extension, the compacting plate 27 keeps the waste material compacted, preventing it from resuming its original shape. The pause time is determined to be the amount of time required for the waste material to "lose" its "memory."

In use of the module 1, a user first opens the drawer 5 and deposits cardboard packaging and plastics materials cartons for storage into the receptacle 19.

Figure 6:
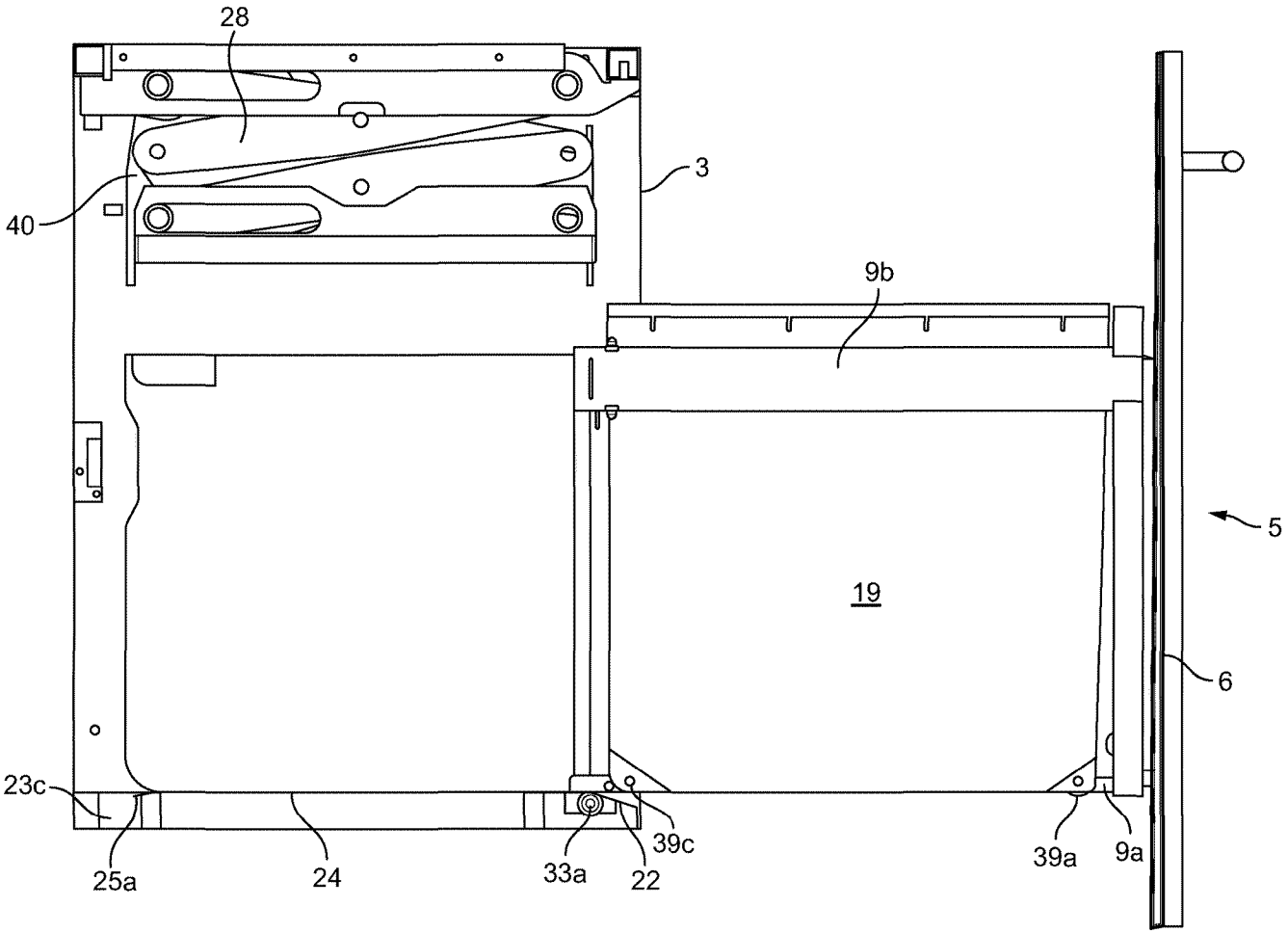
FIG. 6 shows a side cross-sectional view of the waste compacting and storing module of FIG. 1, with the storage unit drawer further pushed in, and the compacting drive means fully retracted.

Referring to FIG. 1, when the drawer 5 is fully slid out, the receptacle 19 is supported by the first, second and third arms 9*a*, 9*b*, 9*c* of the cage-like container part 7. Referring to FIG. 6, as the drawer 5 is slid in, the rear pair of rollers 39*c*, 39*d* of the receptacle 19 engages the first inclined parts 23*a*, 23*b* of the load bearing member 21, starting to lift the rear of the receptacle 19 off of the arms 9*b*, 9*c* of the container part 7.

Figure 7:
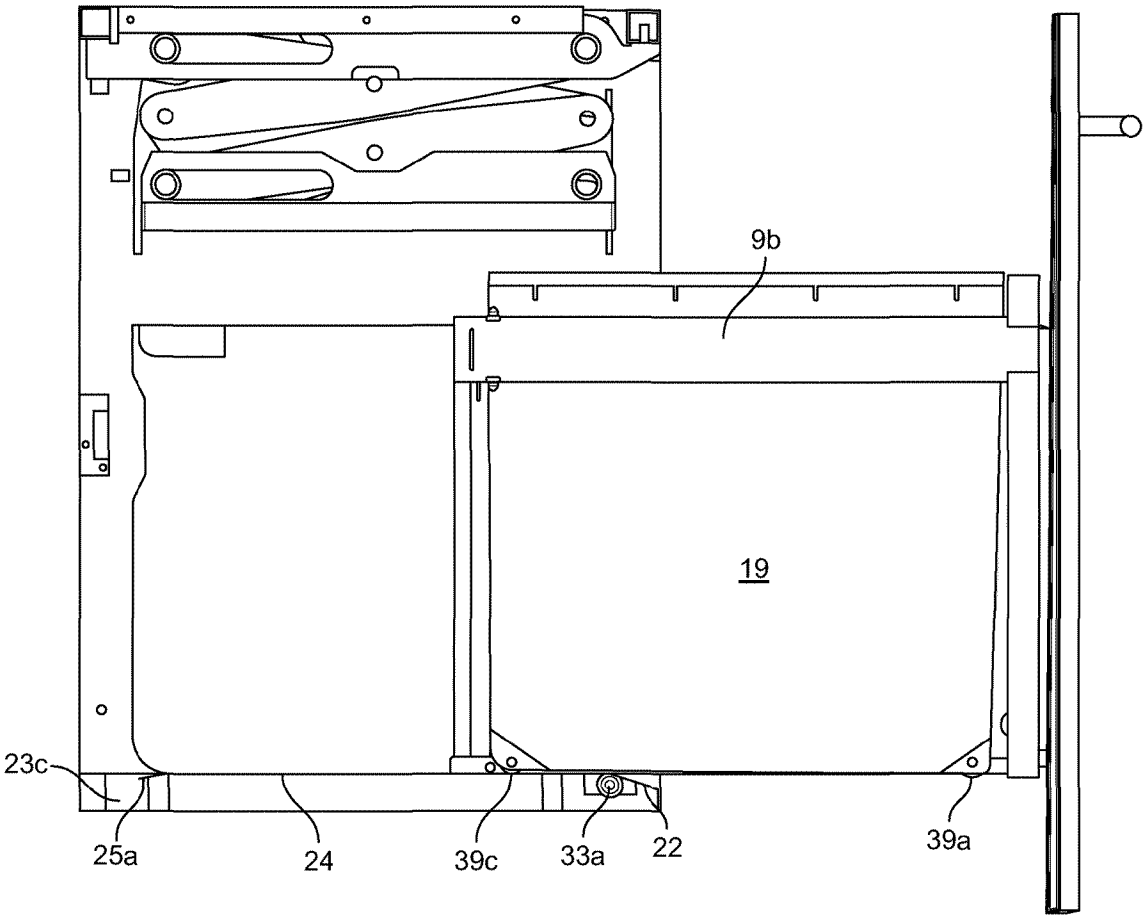
FIG. 7 shows a side cross-sectional view of the waste compacting and storing module of FIG. 1, with the storage unit drawer partially pushed in, and the compacting drive means fully retracted.

Referring to FIG. 7, as the drawer 5 is slid in further, the pair of rollers 33*a*, 33*b* rotatably mounted on axles in a pair of recesses at the point 26 adjacent to the front bottom edge of the module 1 where the load bearing member 21 changes from the first inclined part 22 to the high projecting part 24, engages the bottom 38 of the receptacle 19 and eases the passage of the drawer 5 as it is slid in.

Figure 8:
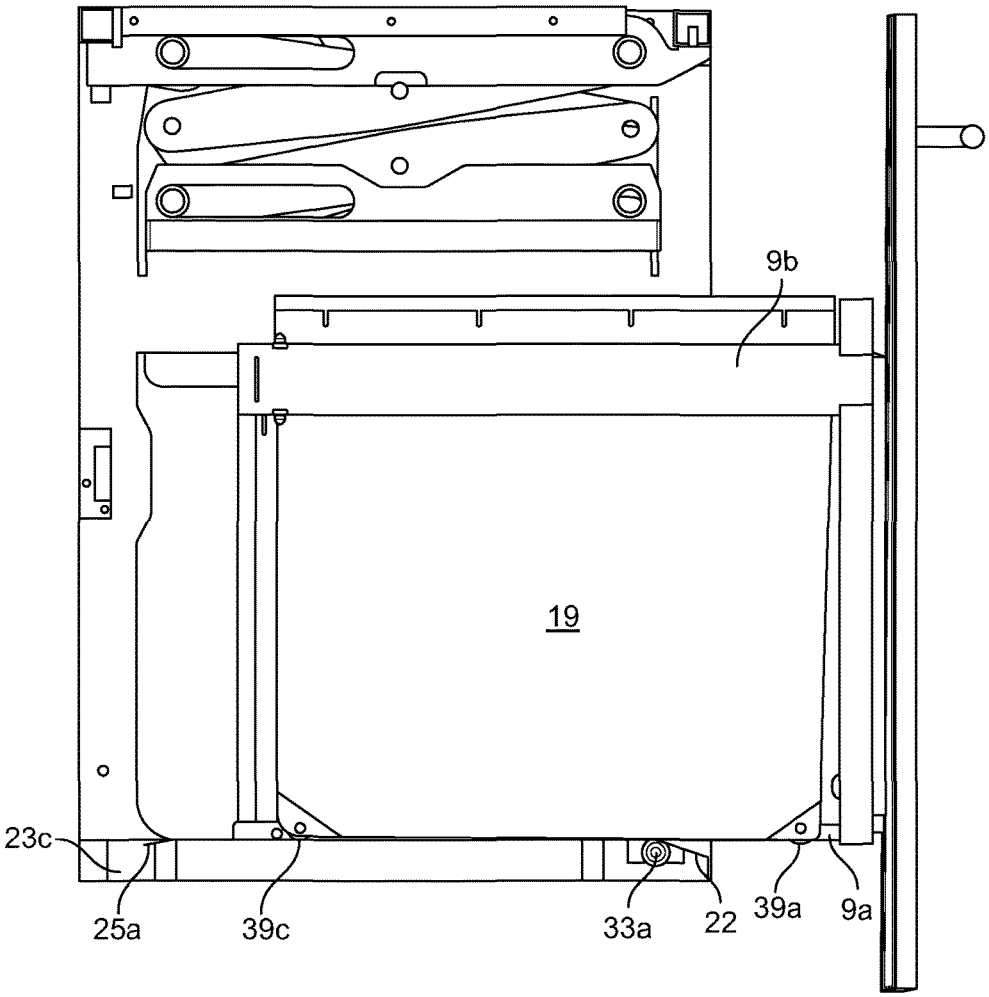
FIG. 8 shows a side cross-sectional view of the waste compacting and storing module of FIG. 1, with the storage unit drawer further pushed in, and the compacting drive means fully retracted.

Referring to FIG. 8, as the drawer 5 is slid in further, the rear pair of rollers 39*c*, 39*d* of the receptacle 19 then engages the high projecting part 24 of the load bearing member 21, lifting the front of the receptacle 19 off of the arms 9*a*, 9*b*, 9*c* of the container part 7.

Figure 9:
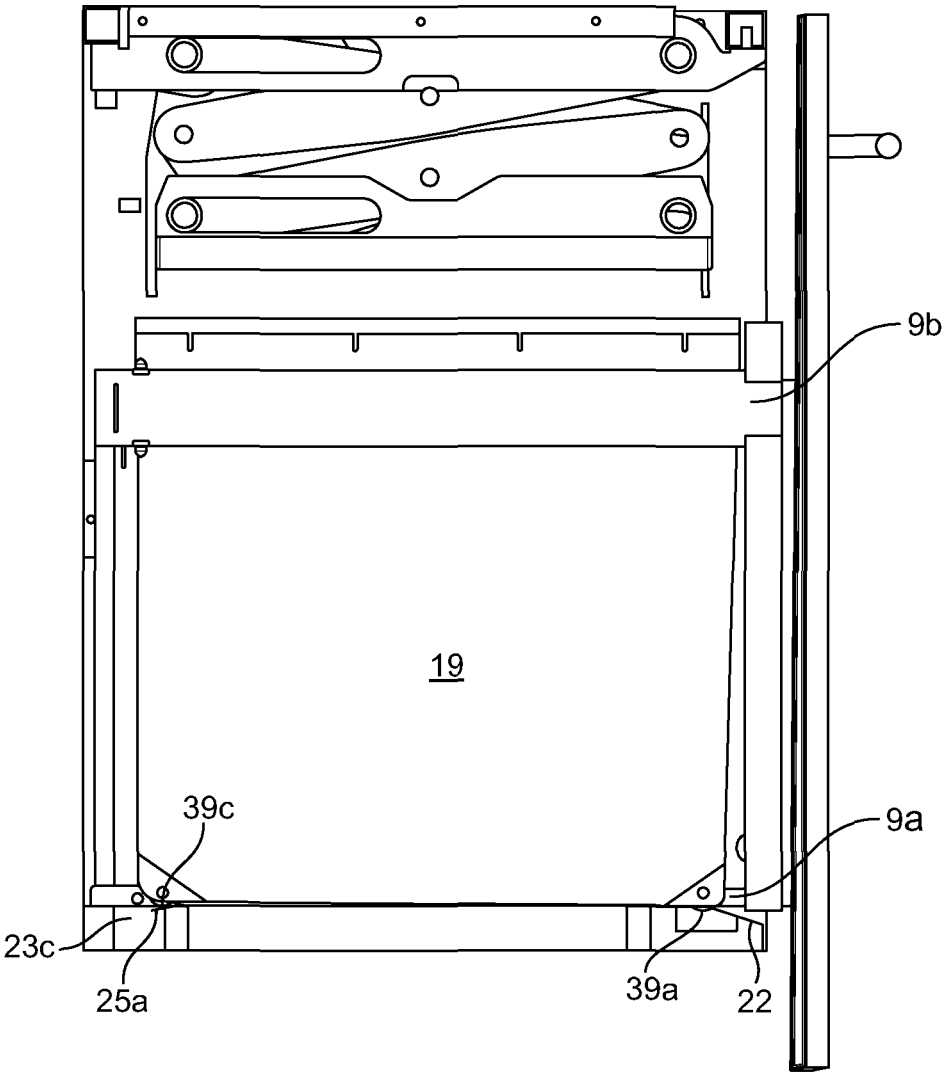
FIG. 9 shows a side cross-sectional view of the waste compacting and storing module of FIG. 1, with the storage unit drawer fully pushed in, and the compacting drive means fully retracted.
Figure 10:
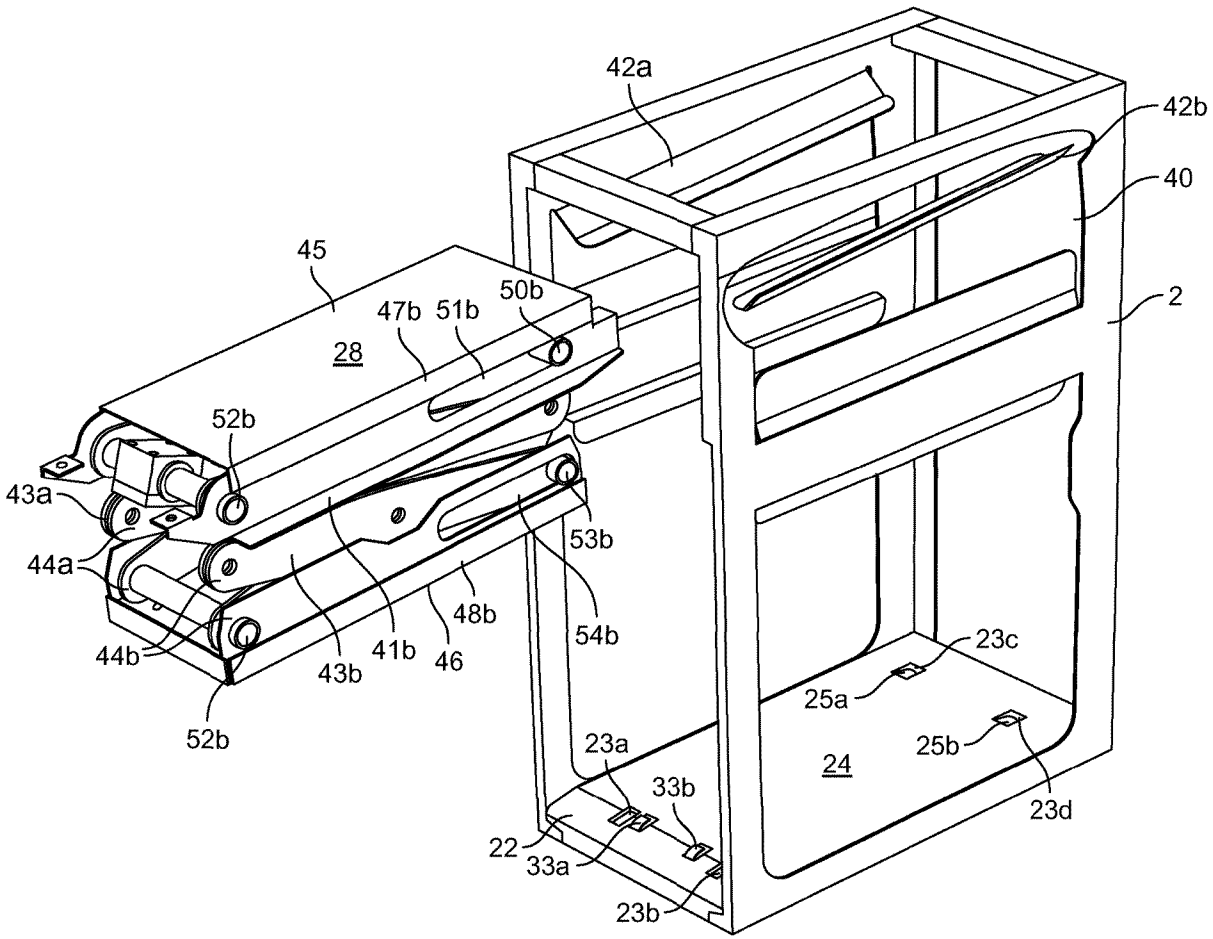
FIG. 10 shows an exploded isometric view of the chassis and the compacting drive means of the waste compacting and storing module of FIG. 1.

Referring to FIG. 9, as the drawer 5 is slid in yet further, the rear pair of rollers 39*c*, 39*d* of the receptacle 19 then run into the slots in the high projecting part 24, down the second inclined part 25*a*, 25*b* onto the second sections 23*c*, 23*d* of the low depressed part 23.

The second inclined part 25*a*, 25*b* and the second sections 23*c*, 23*d* of the low depressed part 23, all near the back of the module 1, are in not in register in the direction of sliding of the drawer 5 with the first sections 26*a*, 26*b* of the low depressed part 26 near the front of the module 1. The slots are thus in register in the direction of sliding of the drawer 5 only with, and only receive, the rear pair of rollers 39*c*, 39*d* of the receptacle 19.

Simultaneously, the front pair of rollers 39*a*, 39*b* of the receptacle 19 then runs into the niches in the first inclined part 22 and the high projecting part 24, which are in register in the direction of sliding of the drawer 5 only with, and receive, the front pair of rollers 39*a*, 39*b* of the receptacle 19.

At this point, the bottom 38 of the receptacle 19 is grounded on and supported by, and the load of the receptacle is then completely taken by, the high projecting part 24 of the load bearing member 21, and the receptacle 19 is no longer supported by the second and third arms 9*a*, 9*b*, 9*c* of the cage-like container part 7.

Once the drawer 5 is fully closed, the user actuates the compacting operation initiation button. This starts the linear ram 29 working and its drive shaft 30 begins to extend from the body 56 of the ram 29. Because of the way that the body 56 of the ram 29 is pivotally attached to a middle pivot point 55*a* of the scissor jack mechanism 28 and the The extension of the drive shaft 30 out of the body 56 of the ram 29 is translated into extension of the scissor mechanism 28, and, as a result the compacting plate 27 is driven downwards, from its parked position, towards the receptacle 19. The scissor mechanism 28 continues to extend and the compactor plate 27 continues to move downwards, further into the receptacle 19.

The downwards movement continues until the compactor plate 27 encounters the packaging, cartons and containers deposited in the receptacle 19, whereupon the compactor plate 27 begins to compact them towards the bottom of the receptacle 19. The compactor plate 27 continues to compact the material until it reaches maximum extension.

At that point the control electronics 31 switches the linear ram 29 to operate in reverse causing the drive shaft 30 to begin to retracting and, consequently, causing the scissor mechanism 28 to retract also. This results in the compactor plate 27 moving back up the receptacle 19 in a withdrawing motion which continues until the compactor plate 27 is back in its rest position. The user is then free to open the drawer 5 and deposit further material for compacting and storing into the receptacle 19.

Alternatively, the user can select one of the alternative modes of compacting operation: either the second or third routine.

When the receptacle 19 is full of compacted recyclable waste material following one or more compacting operations, any such recyclable waste material in the receptacle 19 may be removed by lifting out the pull-out insert 33, which sits in the receptacle 19, and is slidable upwardly out of the receptacle by means of its slot handles 25*a*, 35*b* on each side.

Figure 12B:
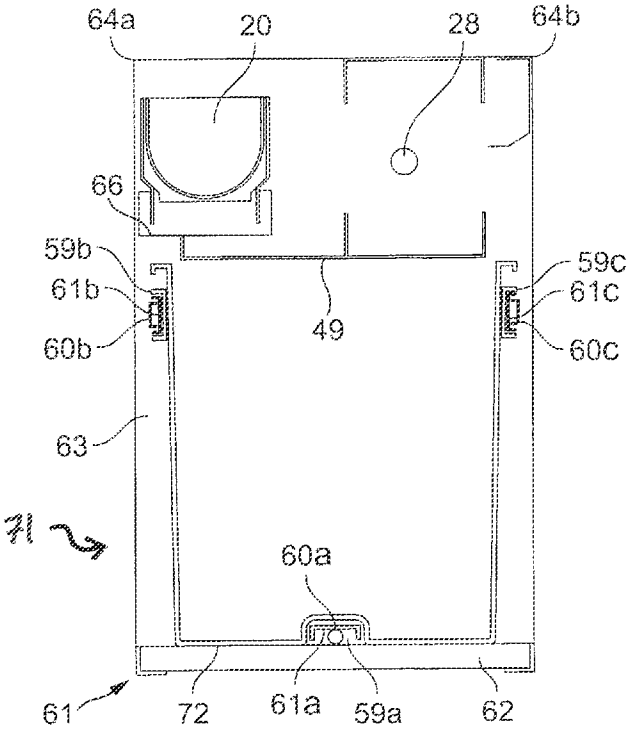
FIG. 12*b* shows a cross-sectional view from the longitudinal mid-point of the extended module of FIG. 12*a* facing rearwardly.
Figure 12A:
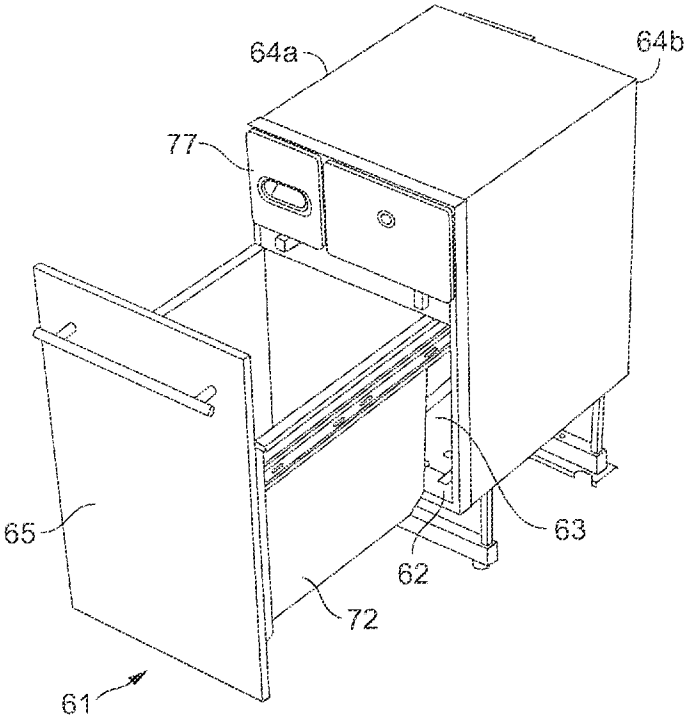
FIG. 12*a* shows an isometric view of an extended module comprising two different modules for crushing, compacting and storing recyclable waste, including the waste compacting and storing module of FIG. 1.

FIG. 12 shows an extended module comprising two different modules for crushing, compacting and storing recyclable waste, including the waste compacting and storing module of FIG. 1.

The term "extended module" as used herein refers to a module for crushing and/or compacting recyclable waste materials which comprises two or more sub-modules. Each sub-module of the extended module performs a different function, such as a sub-module for crushing cans and storing the crushed cans, or for compacting paper, cardboard cartons or cardboard or plastics material containers and storing the compacted materials.

The extended module 61 illustrated comprises two different modules:

A crushing unit 76 comprising a first drawer 77, mounted in, and adjacent to the top left side edge 64*a* of, the chassis 62 of the extended module 61, occupying approximately half of the top one third of the volume of the space 63 within the chassis 62, and extends rearwardly the front of the chassis 62.

An electrically powered drive means 28 of a compacting and storing module 1 for paper, cardboard cartons or cardboard or plastics material containers is mounted in, and adjacent to the right top side edge 64*a* of, the chassis 62, also occupying approximately half of the top one third of the volume of the space 63 within the chassis 62, and extends rearwardly the front of the chassis 62.

The drive means 28 of a compacting and storing module for paper, cardboard cartons or cardboard or plastics material containers 60 is operably connected to compacting means 29 (not shown), here a planar and rectangular plate which extends in a generally horizontal direction.

The drive means 28 and the crushing unit 6 abut each other laterally. Although each component of the module performs different functions, the compacting drive means 28 and the crushing unit 6 share a common storage unit, here a storage unit drawer 65 with a cage-like container part 71 and an open-top generally box-shaped receptacle 72, which is smaller than the container part 71 and is slidably received in the container part 71.

The storage unit drawer 65 is slidably mounted in the chassis 2 below the crushing unit 6 and the compacting drive means 28, such that in use a crushed can drops into it and the drive means 48 drives the compacting means 49 downwardly into the receptacle from a rest position clear of the receptacle before the compacting operation, such that any cans, cartons, packaging or containers in the receptacle are compacted. The drawer 65 occupies the remaining two thirds of the volume of the space 3.

The cage-like container part 71 comprises members which are first, second and third arms 59*a*, 59*b*, 59*c*.

The arms 59*a*, 59*b*, 59*c* extend from a rear face 60 of a drawer front 71 rearwardly in the direction of sliding of the drawer 65 and further extend transversely of the direction of sliding of the drawer 65 to meet adjacent to the rear of the drawer 65. The arms 59*a*, 59*b*, 59*c* are so arranged that they conform to the outside of the receptacle 72 to hold the receptacle 72.

The cage-like container part 71 so formed has a first arm 59*a* in perpendicular relationship with second and third arms 59*b*, 59*c*. Each arm 59*a*, 59*b*, 59*c* comprises a C-shaped channel 60*a*, 60*b*, 60*c* and the chassis 2 comprises three runners 61*a*, 61*b*, 61*c*, each in a position corresponding to one of the first, second and third arms 59*a*, 59*b*, 59*c*. 59*a*, 59*b*, 59*c* Each of the C-shaped channels 60*a*, 60*b*, 60*c* slots and runs over a corresponding runner 61*a*, 61*b*, 61*c*.

Each runner 61*a*, 61*b*, 61*c* comprises first and second members (not shown), wherein the first member is mounted on the chassis 3, extending rearwardly in the direction of sliding of the drawer 45 from the front of the module 41 and the second member loosely conforms internally to the outside of the first member and is held captive by a C-shaped channel, respectively 60*a*, 60*b*, 60*c*, that slots and runs over the corresponding runner second member. This arrangement allows each runner 61*a*, 61*b*, 61*c* to float within controlled limits to take up any inaccuracies in the cage-like container part 51.

The C-shaped channel 60*a* of the first arm 59*a* lies in one plane on the bottom 63 of the chassis 3, and the C-shaped channel 60*b*, 60*c* of each of the other arms 59*b*, 59*c* lies in another plane, perpendicular to the first plane.

Drawer runners usually tend to be rigid in one direction only. Thus, each of the runners 61*b*, 61*c* in a lateral position corresponding to one of the second and third arms 59*b*, 59*c*, and over which each of the C-shaped channels 60*b*, 60*c* slots and runs, are rigid to vertical motion but not lateral. The bottom runner 61*a* in a position corresponding to the first arm 59*a*, and over which the C-shaped channel 60*a* slots and runs, is rigid to lateral motion but not vertical. The bottom runner 61*a* makes the top runners 61*b*, 61*c* more rigid laterally and the top runners 61*b*, 61*c* make the bottom runner 61*a* more rigid vertically.

The perpendicular relationship of the first channel and the second and third channels and between the corresponding runners gives rise to a triangulated structure, which means that the drawer is stable when it is slid in and out and prevented from rocking or rotating, and which prevents runners binding, e.g. a pair of lower runners and channels in parallel with a pair of upper runners and channels preventing the latter from running smoothly, or vice versa.

The perpendicular relationship of the first channel 59*a* and the second and third channels 59*b*, 59*c* give the drawer 65 stability when it is slid in and out and prevent it rocking or rotating, and prevent the drawer runners binding.

In use, a can may be crushed in the crushing unit 6, with the crushed can being dropped from the crushing unit drawer 77 into the receptacle 62, which acts as a storage unit for compacted recyclable waste materials.

Alternatively or subsequently, the drawer 65 is slid outwards, and paper, cardboard cartons or cardboard or plastics material containers are put into the receptacle 72. The drive means 48 drives the compacting plate 49 downwardly into the receptacle 72 from a rest position clear of the receptacle 72 before the compacting operation, such that any cans, cartons, packaging or containers in the receptacle are compacted. Following a compacting operation, the drive means 48 drives the compacting plate 49 in a withdrawing operation out of the receptacle 72 to its rest position clear of the receptacle 72 before the compacting operation. The receptacle 72 then acts as a storage unit for compacted recyclable waste materials.

Figure 13:
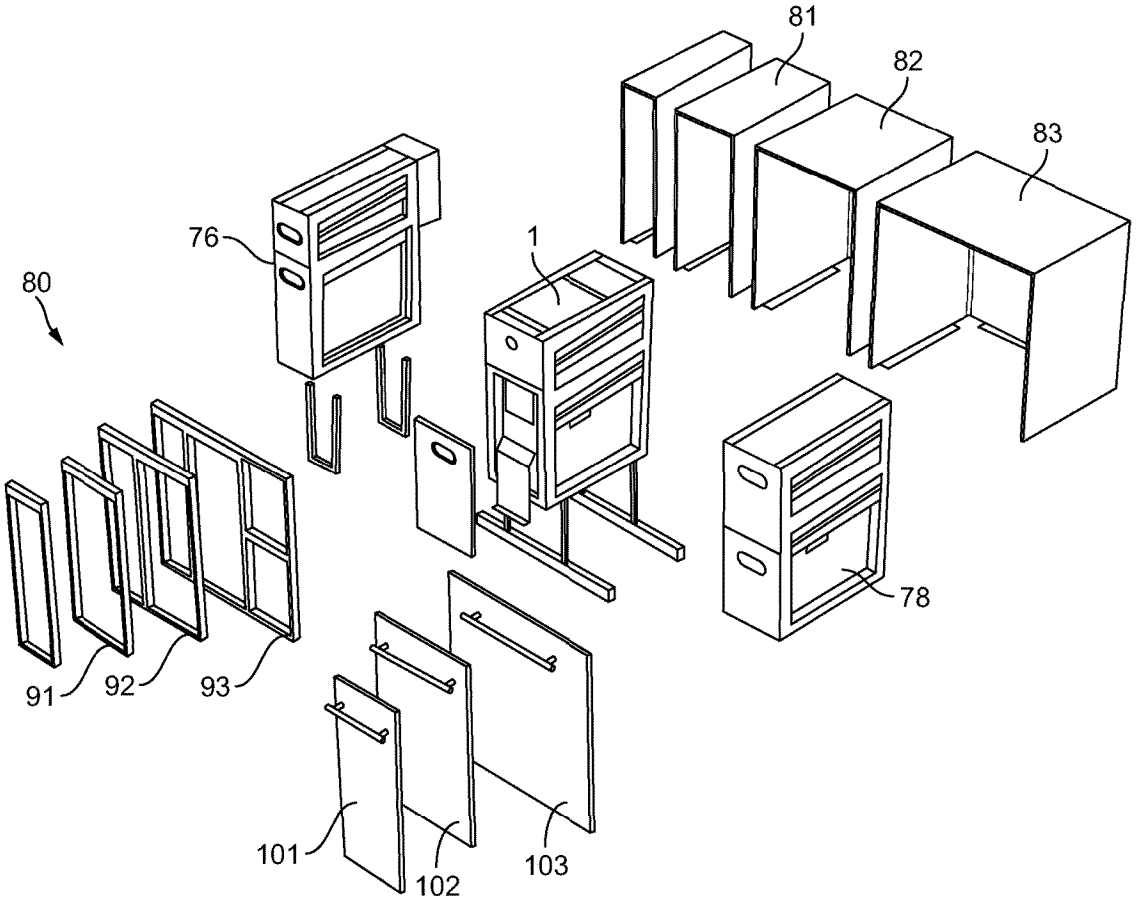
FIG. 13 shows an exploded isometric view of an appliance comprising three different modules for crushing, compacting and/or storing recyclable waste, including the waste compacting and storing module of FIG. 1.

Referring to FIG. 13, a recycling appliance is indicated generally at 80.

The term "appliance" as used herein refers to one or more modules for crushing and/or compacting recyclable waste materials, such as cans, and or storing compacted or non-compacted recyclable waste materials. Each module of the appliance performs one or more different functions. An appliance may consist of any one of the modules or a combination of any two or more of the modules.

The appliances illustrated consist of modules selected from three different modules: a first, left-hand, can crushing and storing module 76; a second, centre, compacting and storing module 1 for paper, cardboard cartons or cardboard or plastics material containers; and, a third, right -hand, storage module 78, e.g. for glass.

The appliance may consist of:

The compacting and storing module 1 for paper, cardboard cartons or cardboard or plastics material containers in the casing 81 with bezel 91 and drawer front 101;

The can crushing and storing module 76 with the compacting and storing module 1 for paper, cardboard cartons or cardboard or plastics material containers in the casing 82 with bezel 92 and drawer front 102;

The can crushing and storing module 76 with the compacting and storing module 1 for paper, cardboard cartons or cardboard or plastics material containers and the storage module 78, e.g. for glass, in the casing 83 with bezel 93 and drawer front 103.

Each module has its own chassis and where the first, can crushing and storing module 76 is combined with the second, compacting and storing module 1 for paper, cardboard cartons or cardboard or plastics material containers; or also with the storage module 83, e.g. for glass, the chassis of the first module 76 is fastened to the chassis of the second module 1 to form an integrated, two-module unit, or the chassis of the third module 78 is also fastened to the chassis of the second module 1 to form an integrated, three-module unit.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A module for storing and compacting packaging, cartons and containers, the module comprising:

a chassis having a front and three runners;

a drawer slidable into and out of the chassis and including a container part, wherein the container part includes three arms that correspond to the three runners of the chassis, wherein each arm runs over a corresponding runner, wherein a first arm of the three arms lies in a first plane, wherein a second arm of the three arms lies in a second plane, wherein a third arm of the three arms lies in a third plane, wherein the second plane and the third plane are parallel to one another, and further wherein the second plane and the third plane each are perpendicular to the first plane;

a receptacle slidably mounted in the drawer and configured to be received by and sit in the container part, wherein the receptacle is slidable relative to the drawer, wherein the module comprises a load-bearing member, wherein the load-bearing member is mounted on a part of the chassis, wherein the load-bearing member engages at least one of the receptacle and the container part when the drawer is slid to a fully closed position, wherein the receptacle is spaced from the load-bearing member when the drawer is slid out of the chassis, and further wherein the load-bearing member engages the receptacle to slide the receptacle vertically upwards relative to the container part when the drawer is slid from a fully open position to the fully closed position;

a compacting means; and a drive means operably connected to the compacting means, wherein the drive means and the compacting means are slidably mounted as a pullout insert in the module, said pullout insert being slidable in and out of the front of the chassis, and further wherein during a compacting operation the drive means drives the compacting means into the receptacle along an operational axis that is upright.

2. The module according to claim 1, wherein the load-bearing member supports the receptacle clear of the container part when the drawer is slid to the fully closed position.

3. The module according to claim 1, wherein the drive means comprises an electrically powered linear ram and a reciprocating drive shaft, wherein the linear ram is connected to the reciprocating drive shaft and wherein the reciprocating drive shaft operates in a generally vertical orientation.

4. The module according to claim 3, wherein the linear ram is a sealed unit.

5. The module according to claim 3, wherein the drive means comprises a scissor jack-type mechanism, and further wherein the scissor jack-type mechanism is connected to the reciprocating drive shaft.

6. The module according to claim 5, wherein the drive means is located in a compactor compartment.

7. The module according to claim 6, wherein the scissor jack-type mechanism comprises two side flanges and the compactor compartment comprises two side runner ledges extending in parallel with the side flanges from front to back over most of the length of the compactor compartment such that the scissor jack-type mechanism is located and supported in the compactor compartment.

8. The module according to claim 3, wherein the reciprocating drive shaft has an operational axis at an angle between 10° and 60° in its rest position prior to a compacting operation.

9. The module according to claim 5, wherein the compacting means comprises a compacting plate.

10. The module according to claim 9, wherein the scissor jack-type mechanism is connected to the compacting plate.

11. The module according to claim 9, wherein the drive means is operable to drive the compacting plate to a first position within the receptacle, withdraw the compacting plate and drive the compacting plate to a second position within the receptacle, and further wherein the second position is situated further into the receptacle than the first position.

12. The module according to claim 9, wherein the drive means is operable to drive the compacting plate to a first position within the receptacle, withdraw the compacting plate to a second position within the receptacle, hold the compacting plate at the second position for a predetermined length of time, and withdraw the compacting plate from the receptacle.

13. The module according to claim 1, further comprising control electronics for the drive means, wherein the control electronics comprise an initiation switch which is operated by the drawer when the drawer is in the fully closed position.

14. The module according to claim 9, wherein the drive means is operable to drive the compacting plate to an extended position and pause for a predetermined time before retracting.

15. The module according to claim 5, wherein the scissor jack-type mechanism comprises a pair of mutually parallel frameworks, and further wherein the linear ram is accommodated between and within the pair of mutually parallel frameworks.

16. An appliance comprising:

(i) a module for storing and compacting packaging, cartons and containers, the module comprising:

a chassis having a front and three runners;

a drawer slidable into and out of the chassis and including a container part, wherein the container part includes three arms that correspond to the three runners of the chassis, wherein each arm runs over a corresponding runner, wherein a first arm of the three arms lies in a first plane, wherein a second arm of the three arms lies in a second plane, wherein a third arm of the three arms lies in a third plane, wherein the second plane and the third plane are parallel to one another, and further wherein the second plane and the third plane each are perpendicular to the first plane;

a receptacle slidably mounted in the drawer and configured to be received by and sit in the container part, wherein the receptacle is slidable relative to the drawer, wherein the module comprises a load-bearing member, wherein the load-bearing member is mounted on a part of the chassis, wherein the load-bearing member engages at least one of the receptacle and the container part when the drawer is slid to a fully closed position, wherein the receptacle is spaced from the load-bearing member when the drawer is slid out of the chassis, and further wherein the load-bearing member engages the receptacle to slide the receptacle vertically upwards relative to the container part when the drawer is slid from a fully open position to the fully closed position;

a compacting means; and a drive means operably connected to the compacting means, wherein the drive means and the compacting means are slidably mounted as a pullout insert in the module, said pullout insert being slidable in and out of the front of the chassis, and further wherein during a compacting operation the drive means drives the compacting means into the receptacle along an operational axis that is upright; and (ii) a second module for crushing and storing cans.

17. The appliance according to claim 16, wherein the chassis of the module is a first chassis, and wherein the second module comprises a second chassis that is fastened to the first chassis.

* * * * *